US009978186B2

(12) United States Patent
LaFergola et al.

(10) Patent No.: US 9,978,186 B2
(45) Date of Patent: May 22, 2018

(54) INFORMATION REPORTING SYSTEM FOR MANAGING A FLEET OF AN INDUSTRIAL VEHICLES

(75) Inventors: Joseph Victor LaFergola, Vestal, NY (US); Vicki Haberman, Atlanta, GA (US); Michelle Swindell Berryman, Marietta, GA (US); Alfredo Gonzalo Aponte, Atlanta, GA (US); Valerie Marie Jencks, Marietta, GA (US)

(73) Assignee: The Raymond Corporation, Greene, NY (US)

( * ) Notice: Subject to any disclaimer, the term of this patent is extended or adjusted under 35 U.S.C. 154(b) by 2150 days.

(21) Appl. No.: 12/647,624

(22) Filed: Dec. 28, 2009

(65) Prior Publication Data

US 2010/0179844 A1 Jul. 15, 2010

Related U.S. Application Data

(60) Provisional application No. 61/143,499, filed on Jan. 9, 2009.

(51) Int. Cl.
*G07C 5/00* (2006.01)
*G07C 5/08* (2006.01)

(52) U.S. Cl.
CPC ..... *G07C 5/008* (2013.01); *G07C 5/08* (2013.01); *G07C 5/006* (2013.01)

(58) Field of Classification Search
CPC ..... G07C 5/0008; G07C 5/008; G07C 5/006
See application file for complete search history.

(56) References Cited

U.S. PATENT DOCUMENTS

| | | | | |
|---|---|---|---|---|
| 5,295,244 | A | 3/1994 | Dev et al. | |
| 5,922,040 | A | 7/1999 | Prabhakaran | |
| 6,292,806 | B1 | 9/2001 | Sandifer | |
| 7,139,686 | B1 * | 11/2006 | Critz et al. | 703/2 |
| 7,171,381 | B2 * | 1/2007 | Ehrman et al. | 705/28 |

(Continued)

FOREIGN PATENT DOCUMENTS

CA 2621999 A1 2/2008

OTHER PUBLICATIONS

A breakthrough for fleet management and OH&S: Linde FleetFOCUS; Linde Material Handling Pty Ltd; as retrieved from https://www.forkliftaction.com/advertorials/A-breakthrough-for-fleet-management-and-OHS-Linde-FleetFOCUS-5953.aspx5953 (Year: 2008).*

*Primary Examiner* — Deirdre D Hatcher
(74) *Attorney, Agent, or Firm* — Quarles & Brady LLP

(57) ABSTRACT

Operational data are transmitted, by each of a plurality of material handling vehicles at a facility, into a communications system. A computer connected to the communications system processes the operational data and presents reports on a monitor screen. The computer operates in an impact report mode which provides reports about material handling vehicle impacts with objects, a maintenance report mode for reports pertaining to vehicle maintenance, a verify report mode presenting reports about vehicle inspections, and a metrics report mode for reports describing amounts of work performed by the vehicles, and an overview mode summarizes information from each of other report modes. Each report mode has different display modes which summarize data for a group of the vehicles or provide detailed information about one particular vehicle or one specific vehicle operator.

30 Claims, 18 Drawing Sheets

(56) References Cited

U.S. PATENT DOCUMENTS

| | | | | |
|---|---|---|---|---|
| 7,395,275 | B1 | 7/2008 | Parent et al. | |
| 2002/0016757 | A1* | 2/2002 | Johnson et al. | 705/36 |
| 2002/0140699 | A1 | 10/2002 | Miyadai | |
| 2003/0069648 | A1* | 4/2003 | Douglas et al. | 700/2 |
| 2003/0212960 | A1 | 11/2003 | Shaughnessy et al. | |
| 2004/0073468 | A1* | 4/2004 | Vyas et al. | 705/8 |
| 2005/0125247 | A1 | 6/2005 | Ding et al. | |
| 2006/0048048 | A1 | 3/2006 | Welcker et al. | |
| 2007/0078791 | A1* | 4/2007 | Vyas et al. | 705/400 |
| 2008/0086427 | A1* | 4/2008 | Wallace | 705/36 R |
| 2008/0097944 | A1* | 4/2008 | Kelly et al. | 706/21 |
| 2008/0154712 | A1* | 6/2008 | Wellman | 705/11 |
| 2009/0072977 | A1* | 3/2009 | Johnson et al. | 340/572.4 |
| 2009/0099898 | A1 | 4/2009 | Ehrman et al. | |
| 2010/0174627 | A1* | 7/2010 | Daniels | 705/30 |
| 2011/0040440 | A1* | 2/2011 | de Oliveira et al. | 701/30 |
| 2011/0107241 | A1* | 5/2011 | Moore | 715/760 |
| 2011/0107265 | A1* | 5/2011 | Buchanan et al. | 715/835 |

* cited by examiner

INFORMATION REPORTING SYSTEM FOR MANAGING A FLEET OF AN INDUSTRIAL VEHICLES

CROSS-REFERENCE TO RELATED APPLICATION

This application claims benefit of U.S. provisional patent application No. 61/143,499 filed Jan. 9, 2009.

STATEMENT CONCERNING FEDERALLY SPONSORED RESEARCH OR DEVELOPMENT

Not applicable.

BACKGROUND OF THE INVENTION

1. Field of the Invention

The present invention relates to a system for managing a fleet of material handling vehicles, such as lift trucks; and more particularly to a system for reporting on the performance of that fleet and the operators of the industrial vehicles.

2. Description of the Related Art

Material handling vehicles are powered vehicles commonly used in a warehouse or a factory to transport, store, and retrieve materials and finished goods. A human operator either sits on a seat or stands on a platform at the rear of the vehicle and manipulates controls which govern movement across the warehouse or a factory floor and operation of forks or a platform on which items are carried. Examples of material handling vehicles include, but are not limited to, fork lift trucks, order pickers, stand-up counterbalanced lift trucks, sit-down counterbalanced lift trucks, lift trucks and tow tractors.

Although in a typical vehicle there are a variety of possible operator orientations, when traveling, an operator will favor positions that maximize comfort and visibility for forks first and tractor first travel. Generally, one operator orientation is used more frequently than the others. The prevalent orientation varies with vehicle design, from facility to facility, within a given facility, and even from operator to operator.

In warehousing operations, material quantities and inventory turnover rates are increasing rapidly. Therefore, to maintain competitiveness, it is important for warehousing operations to have accurate information about inventory, and to ensure that each piece of equipment, and each employee is productive. Recent studies, in fact, have indicated that 70 percent to 80 percent of the cost of owning and operating a material handling vehicle is attributed to labor. For a warehouse to compete on the global level, continually improving operator productivity is vital to reducing costs. To meet these ends, warehouse management systems are frequently employed to control inventory, ensure proper maintenance of equipment, and to monitor operator efficiency. In these warehouse management systems, a centralized computer system can be used to monitor inventory flow, maintenance status of fleets of industrial vehicles, and operator performance parameters.

To provide these functions, wiring harnesses and sensors are typically added to the vehicles in a fleet of material handling vehicles after manufacture. These wiring harnesses connect sensors and other devices into the system, and add a number of connection points within the vehicle. Because of the large number of connection points, these ad-on systems can be susceptible to failure. In addition, these post-manufacture sensors provide only limited information, and can be inaccurate.

It is desirable that the operating information regarding the material handling vehicles be compiled into a form that is useful by warehouse management to review the efficiency of the vehicle fleet and determine when operational changes are required. Such changes include deploying the material handling vehicles to proper locations, acquiring additional material handling vehicles, and determining the different types of material handling vehicles needed. It is further desirable that the raw operating data and analysis of that data be presented to warehouse management personnel in easy to understand forms and in a manners in which the personnel can review the information from a summary of the material handling vehicle operation for the entire company, a particular warehouse, on down to an individual vehicle or operator level.

SUMMARY OF THE INVENTION

A system for managing a fleet of material handling vehicles at a facility, such as a warehouse, for example, includes a communication interface on each material handling vehicle which transmits data regarding vehicle operation. As an example, the communication interface is connected to a vehicle management computer that produces the data in response to signals from sensors and other devices on the respective material handling vehicle.

A communications system in the facility receives the data from the communication interface on each material handling vehicle. A computer system is connected to the communications system and comprises a processor, a user input device and a monitor having a screen on which information is displayed. The computer system processes the data from each of the material handling vehicles and, uses the results of the processing to present reports on the screen.

The computer system operates in a plurality of report modes that include an impact report mode presenting reports about impacts of material handling vehicles with objects, a maintenance report mode that presents reports about maintenance and service performed on the material handling vehicles, and a verify report mode presenting data about inspections performed on the material handling vehicles. In addition, a metrics report mode provides reports about amounts of work performed by the material handling vehicles, and an overview report mode presents an overview report that summarizes information from each of the impact, maintenance, verify, and metrics report modes.

The computer system transitions from the overview report mode to another report mode that is selected in response to activation of the user input device. Each of the impact, maintenance, verify, and metrics report modes has a summary display mode, a list display mode, and a trend display mode that are individually selectable in response a user activating the input device to select an element presented on the screen. The summary display mode has a format that graphically presents data complied from the plurality of material handling vehicles at the facility, and the list display mode individually lists data about each of at least some of the plurality of material handling vehicles. The trend display mode graphically presents a trend line of data during a defined time period.

In one embodiment, each of the impact, maintenance, verify, and metrics report modes has a first display mode with a format that graphically presents data complied from the plurality of material handling vehicles at the facility, and in response to activating the input device to select an element presented on the screen in the first display mode, the computer system transitions to a second display mode that presents information pertaining to only one material handling vehicle designated by the element. The user also is able, via activation of the input device, alternatively to select detailed information about a specific operator of a material handling vehicle.

These and other aspects of the invention will become apparent from the following description. In the description, reference is made to the accompanying drawings which form a part hereof, and in which there is shown a preferred embodiment of the invention. Such embodiment does not necessarily represent the full scope of the invention and reference is made therefore, to the claims herein for interpreting the scope of the invention.

DETAILED DESCRIPTION OF THE PREFERRED EMBODIMENT

Figure 1:
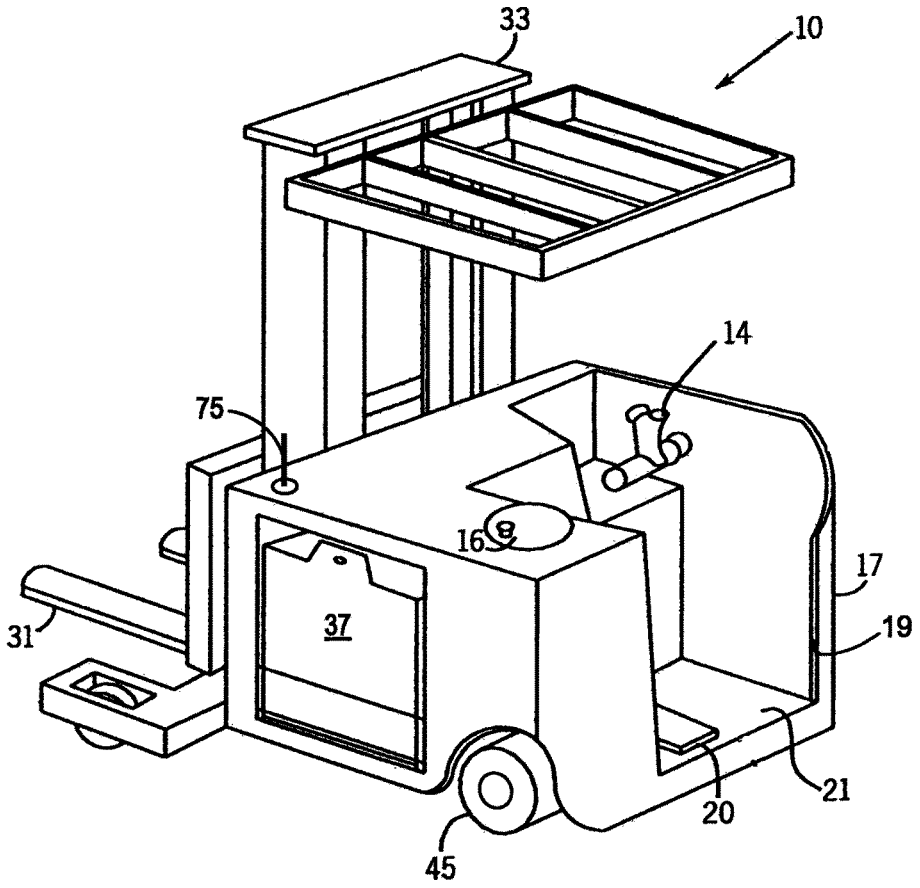
FIG. 1 is a perspective view of a material handling vehicle that has components of a warehouse communications system for exchanging operational data between a vehicle controller and a warehousing management system in accordance with the present invention.

Referring initially to FIG. 1, a material handling vehicle 10, such as a lift truck, includes an operator compartment 17 with an opening 19 for entry and exit of the operator. The operator compartment 17 contains a control handle 14 and a deadman switch 20 positioned on the floor 21. The deadman switch 20 must be closed by the operator's foot before any of the motors on the material handling vehicle can operate, which prevents run away operation of the vehicle. A steering wheel 16 is also provided in the operator compartment 17. An antenna 75 for wireless communications with an external warehousing system is coupled to the material handling vehicle and is, as described more fully below, connected to an internal vehicle controller 12 (FIG. 2) to provide bidirectional communications from the vehicle controller 12 to a warehousing system. Although the material handling vehicle 10 as shown by way of example as a standing, fore-aft stance operator configuration lift truck, it will be apparent to those of skill in the art that the present invention is not limited to vehicles of this type, and can also be provided in other types of material handling vehicles including, without limitation, fork lift trucks, pallet trucks, platform trucks, counterbalanced fork lift vehicles, and other powered vehicles used in a warehouse or a factory to transport, store, and retrieve items.

Figure 2:
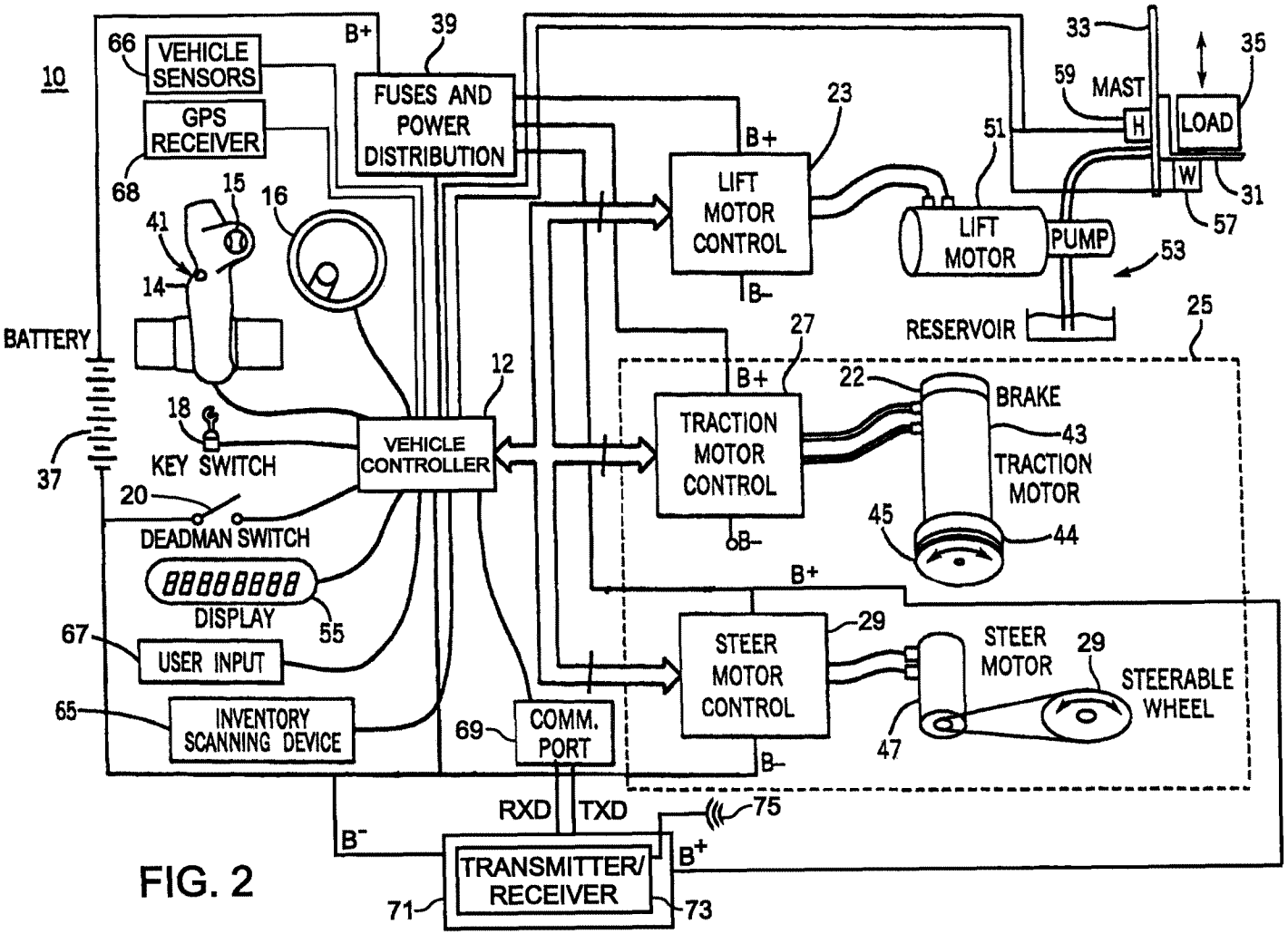
FIG. 2 is a block diagram of a control system of the material handling vehicle.

With reference to FIG. 2, the material handling vehicle comprises a vehicle controller 12 which receives operator input signals from the operator control handle 14, the steering wheel 16, a key switch 18, and the deadman switch 20 and, based on the received signals, provides command signals to each of a lift motor control 23 and a drive system 25 that includes both a traction motor control 27 and a steer motor control 29. The drive system 25 provides a motive force for driving the material handling vehicle in a selected direction, while the lift motor control 23 drives forks 31 along a mast 33 to raise or lower a load 35, as described below. The material handling vehicle and vehicle controller 12 are powered by one or more battery 37, coupled to the vehicle controller 12, drive system 25, steer motor control 29, and lift motor control 23 through a bank of fuses or circuit breakers 39.

As noted above, the operator inputs include a key switch 18, deadman switch 20, steering wheel 16, and an operator control handle 14. The key switch 18 is activated to apply power to the vehicle controller 12, thereby enabling the material handling vehicle. The deadman switch 20 provides a signal to the vehicle controller 12 for operating the brake 22 to provide a deadman braking device, disabling motion of the vehicle unless the deadman switch 20 is activated by the operator. The deadman switch 20 also must be closed before the lift motor 51 or the steering motor 47 can operate.

The operator control handle 14 provides a travel request signal to the vehicle controller 12. Typically, the handle 14 is rotated in a vertical plane to provide a travel direction and speed command of motion for the material handling vehicle. A four-way switch 15 located on the top of the handle 14 provides a tilt up/down function when activated in the forward and reverse directions and a side shift right and left function when activated to the right and left directions. A plurality of control actuators 41 located on the handle 14 provide a additional functions, and can include, for example, a reach push button, a retract push button, and a horn push button as well as a potentiometer providing a lift function. A number of other functions could also be provided, depending on the construction and intended use of the material handling vehicle.

The traction motor control 27 drives one or more traction motor 43 which is connected to wheel 45 to provide motive force to the lift truck. The speed and direction of the traction motor 43 and associated wheel is selected by the operator from the operator control handle 14, and is typically monitored and controlled through speed and distance signals provided by a rotation sensor 44 which can be an encoder or other feedback device coupled to the traction motor 43, and which can also be used to provide feedback for determining a distance traveled by the material handling vehicle. The wheel 45 is also connected to friction brake 22 through the traction motor 43, to provide both a service and parking brake function for the material handling vehicle. The friction brake 22 can be a spring-activated brake that defaults to a "brake on" position, such that the switch 20 and associated brake 22 therefore provide the deadman braking function. The operator must provide a signal indicating that the deadman brake is to be released to drive the truck, here provided by the deadman switch 20, as described above. The traction motor 43 is typically an electric motor, and the associated friction brakes 22 can be either electrically operated or hydraulically operated devices. Although one friction brake 22, traction motor 43, and wheel 45 are shown, the material handling vehicle can include one or more of these elements.

The steer motor control 29 is connected to drive a steering motor 47 and associated steerable wheel 49 in a direction selected by the operator by rotating the steering wheel 16, described above. The direction of rotation of the steerable wheel 49 determines the direction of motion of the material handling vehicle.

The lift motor control 23 provides command signals to control a lift motor 51 which is connected to a hydraulic circuit 53 for driving the forks 31 along the mast 33, thereby moving the load 35 up or down, depending on the direction selected at the control handle 14. In some applications, the mast 33 can be a telescoping mast. Here, additional hydraulic circuitry is provided to raise or lower the mast 33 as well as the forks 31. As shown here, a height sensor 59 is provided in the mast control system to provide a signal to the vehicle controller 12 indicating the height of the mast 33. The height sensor 59 can be, for example, an encoder, a flow sensor in the hydraulic system, a light beam, or other types of sensors. Similarly, a weight sensor 57 is provided on the forks 31. The weight sensor 57 can be, for example, a load cell, strain gauge, light beam or pressure sensor in the lift system and provides a signal to the controller 12 that indicates whether a load is on the forks, and a weight of the load.

In addition to providing control signals to the drive system and lift control system, the vehicle controller 12 can also furnishes data to a display 55 that provides information to the operator. Information presented on the display 55 can include, for example, a number of pallets moved, a number of pallets moved over a period of time, an average number of pallets moved by the vehicle, a weight of a pallet or load placed on the forks 31, the speed of the vehicle, the time, or maintenance information. Although not shown here, temperature sensors can also be included to monitor the temperature of the motors and other components.

Referring still to FIG. 2, a number of data input and output devices also are connected to the vehicle controller 12, including, for example, a user input 67, an inventory scanning device 65, vehicle sensors 66 for parameters such as temperature, and a communications port 69. The user input 67 allows the operator, a supervisor, or other personnel to enter data into the vehicle controller 12, and can be implemented as a touch screen in display 55, a keyboard, a series of input keys, a mouse, joystick or other input device as will be apparent to those of ordinary skill in the art. The inventory scanning device 65, can be, for example, a barcode reader, radio frequency identification (RFID) reader, data entry pad, RuBee™ or other IEEE P1902.1 standard reader or other device capable of reading corresponding identifiers such as RFID tags, IEEE P1902.1 tags, barcodes or other symbols associated with a pallet or other load.

The communications port 69 is connected to a warehouse communication interface 71 which is mounted to the material handling vehicle and connected to the battery 37 of the vehicle electrical system. The warehouse communication interface 71 includes circuitry 73 and an antenna 75 for bidirectional, wireless communication with a communications system in the warehouse using any one of several well-known protocols.

Figure 3:
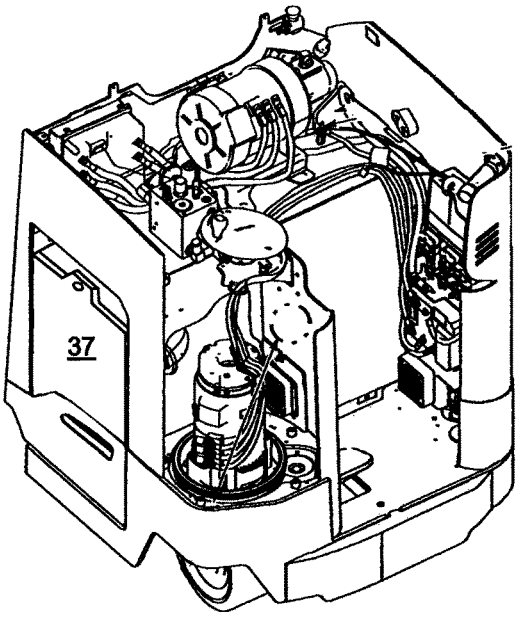
FIG. 3 is a partial rear view of the material handling vehicle with the housing removed to show the connection of a warehouse communication system to the vehicle.
Figure 4:
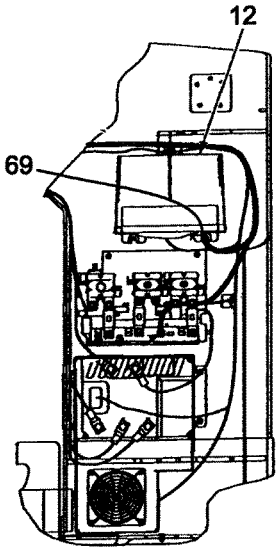
FIG. 4 is a partial view of the of FIG. 3A illustrating connections to a terminal strip for coupling a device for the communication system to the wiring harness.
Figure 5:
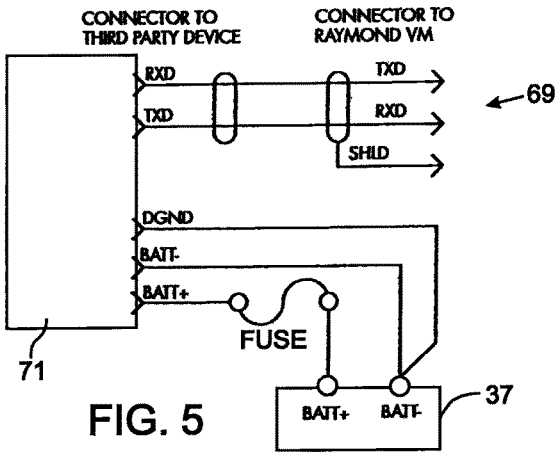
FIG. 5 is a circuit diagram of a wiring harness for connecting a wireless communications device to the control system in the material handling vehicle.

Referring now to FIGS. 3-5, the communication port 69 is provided in the wiring harness of the truck 10 adjacent a housing for the vehicle controller 12. The communication interface 71 includes a mating connector that can be connected directly to the communications port 69. As shown here, additional connections are made to a terminal strip to provide power connections to the battery 37. However, it will be apparent that battery power could also be routed directly through the communications port 69. Once the communications port 69 is connected to the communication interface 71, a bi-directional communications link is established with the vehicle controller 12. This connection allows the transmission of sensor data, operational state data, and switch and control state data from the vehicle controller 12 to external devices. Additionally, because the communication interface 71 is connected directly to the vehicle controller 12, command signals from external apparatus can be applied to the vehicle, enabling signals to limit the speed of the vehicle, limit acceleration, provide data on a display, and lock out the vehicle, as well as control other functions of the vehicle, as described more fully below.

Although a communications port 69 and associated communication interface 71 are shown here, it will be apparent that the communications to a warehouse management system could be transmitted directly to and from the vehicle controller 12. Preferably, however, a standardized RS-232 communications protocol is used to provide communications into and out of the vehicle controller, thereby enabling the use of different communication interfaces 71 and warehousing computer systems with the vehicle 10. By providing simple connections and a standard protocol, the system of the present invention is adaptable for use with a number of different warehousing systems.

Referring again to FIG. 2, the vehicle controller 12 stores data regarding the operation of the material handling vehicle. That data can include number of hours in operation, battery state of charge, and fault codes encountered. The hours of operation is calculated as a function of the time that the that the deadman switch 20 is depressed, referred to as "deadman hours." Alternatively, the operating hours can be the time that the key switch 18 is closed, the lift motor 51 is active, or that the material handling vehicle 10 is traveling based on feedback from rotation sensor 44 connected to the traction motor 43. In addition, operation of the lift can be monitored using the time that the lift motor 51 is active. Various speed parameters such as speed and acceleration of the vehicle and of the mast 33 can also be monitored. The vehicle operational data are collected and stored in a memory or other storage device within the vehicle controller 12.

The vehicle operational data also includes an operator identifier, such as a name or employee number, which is entered, through a user input 67 connected to the vehicle controller 12 or through a user interface display associated with the warehouse communication interface 71. Additionally, operator checklists, including those mandated by the U.S. Occupational Safety and Health Administration (OSHA), can be presented to the operator either through display 55 or a display associated with the communication interface 71. Data acquired from these checklists can be associated with the operator along with data related to that person's driving performance. For example, average vehicle acceleration rate and speed may be monitored, as well as collision data, number of pallets moved, or other data useful in monitoring operator performance, productivity, and efficiency. The operator employs the user input 67 to enter responses to the checklist items.

Figure 6:
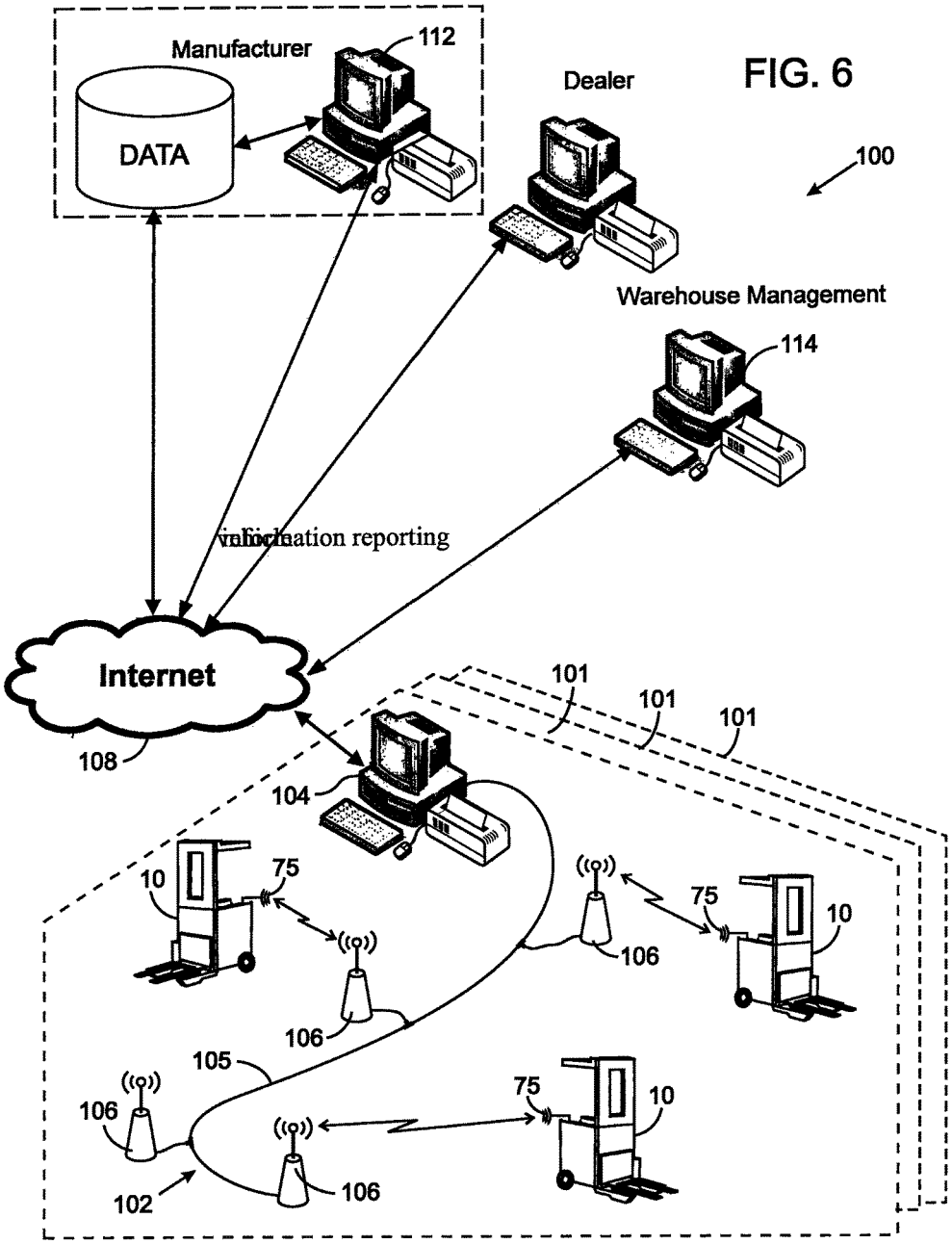
FIG. 6 is an illustration of a vehicle information system in which a material handling vehicle operating in a warehouse exchanges data with a warehouse computer system.

Referring now also to FIG. 6, a vehicle information system 100 is provided for one or more warehouses 101, in which material handling vehicles 10 operate. The present invention is being described in the context of an exemplary company that has three facilities in the form of warehouses. Each warehouse 101 includes communications system 102 that links the vehicles therein to a centralized warehouse computer system 104. The communications system 102 has a plurality of wireless access points 106 distributed through a warehouse 101, such as in a shipping dock and in goods storage areas. The centralized warehouse computer system 104 communicates with the wireless access points 106 through a communications link 105, which is depicted as a hardwired local area network, however, the communications link may be implemented by a connection through the internet, a wi-fi system, or other wireless link.

Figure 7:
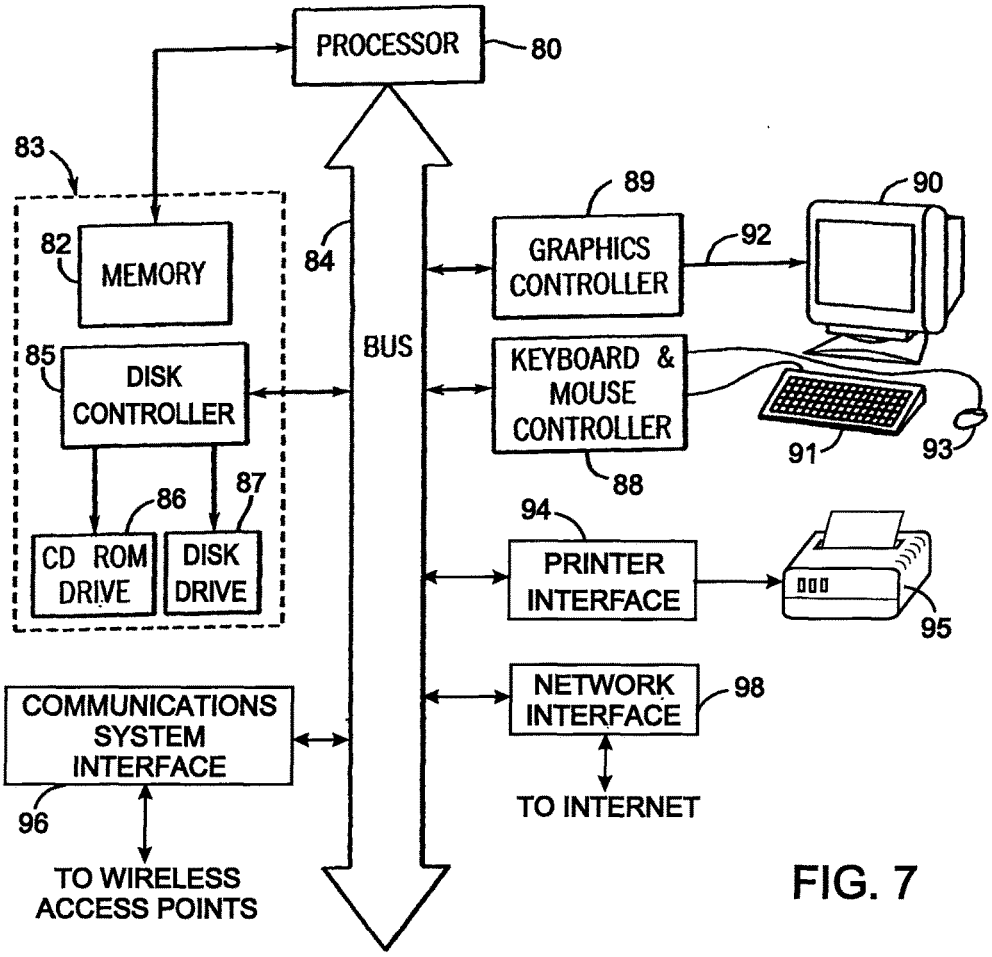
FIG. 7 is a block schematic diagram of warehouse computer system that analyzes the operational data gathered from the material handling vehicle.

With reference to FIG. 7, the warehouse computer system 104 includes a processor 80 which executes program instructions stored in a memory 82 that forms part of a storage section 83. The processor 80 is a commercially available device designed to operate with a Microsoft Windows® operating system, for example. It includes internal memory and I/O control to facilitate system integration and integral memory management circuitry for handling all external memory 82. The processor 80 also includes a bus driver which provides a direct interface with a multi-bit bus 84.

The bus 84 is an industry standard bus that transfers data between the processor 80 and a number of peripheral controller cards. These include a disk controller 85 which provides a high-speed transfer of data to and from a CD ROM drive 86 and a disk drive 87. A graphics controller 89 couples the bus 84 to a monitor 90 through a standard video connection 92, and a keyboard and mouse controller 88 receives data that is manually input through a keyboard 91 and mouse 93. The keyboard 91 and mouse 93 are each a "user input device" by which a human interfaces with a computer system. The warehouse computer system 104 includes has a printer 95 coupled to the bus 84 by a printer interface 94 so that reports and monitor screen displays can be printed in hardcopy form. The graphics controller 89 and the monitor 90, along with the processor 80 when executing the appropriate software, are considered as forming a report generator. The bus 84 also connects to a communications system interface 96 that connects to the wireless access points 106, and a network interface 98 is provided to couple the warehouse computer system 104 to a wide area network, such as the Internet.

Returning to FIG. 6, the warehouse management computer system 114 at the headquarters of the warehouse company is similar to that described for the warehouse computer system 104 in so far as the present invention is concerned. Thus both warehouse computer system 104 and the headquarters computer system 114 execute the same software for analyzing and reporting the operating information for the material handling vehicles.

The warehouse computer system 104 preferably is connected to a wide area network which, can be an Internet link 108 as shown here or other types of wired or wireless networks. Through the Internet link 108, the warehouse computer system 104 is connected to a database 110 which stores vehicle specific data provided by the manufacturer through manufacturer computer system 112. Selected data can also be accessed by, for example, warehouse management personnel or vehicle dealers, who can connect to the database 110 through the Internet link 108.

Data stored in the database 110 pertaining to a specific material handling vehicle can be accessed by using the vehicle serial number and that detailed data can include, for example, the types of information listed in Table 1.

TABLE 1

| VEHICLE INFORMATION |
|---|
| Truck documentation and parts & service manuals |
| Field service bulletins and other information |
| As built Bill of Materials (BOM) |
| Options added (truck modification history) |
| As built performance information (QAP) |
| Service history (parts, labor, tech observations) |
| Operating history (impacts, hour meters, fault codes, age) |
| Use/maintenance history (hour meters, fault codes, BSOC) |
| Sale/resale history |
| End of service date |

A model number can be used to access general information pertaining to the type of material handling vehicle, such as parts & service manuals.

Referring to FIGS. 2 and 6, the material handling vehicle 10 employs the communication interface 71 and antenna 75 to wirelessly transmit its serial number, an operator identifier, and vehicle operational data through antenna 75. The wireless signals are received by the communications system 102 which conveys the serial number and operational data to the warehouse computer system 104. Those wireless transmissions can occur continuously while the vehicle is operating, at defined time intervals, or upon an occurrence of a given event such as the end of a work shift or a fault condition. The information gathered from each vehicle 10, then is relayed occasionally through the internet link 108 to the database 110 and also may be sent to the computer system 114 at the headquarters of the warehouse company.

Because of the bidirectional communications between the vehicle controller 12 and the warehouse communications system, the warehouse communications system 102 can also control operating parameters of the material handling vehicle. In particular, the system can control the maximum speed and acceleration of the truck in both the forward and reverse travel directions. Other vehicle functions, such as the horn, can also be activated by the warehouse computer system 104, as an alarm when certain operating conditions are detected.

Thus, for example, the warehouse control system can correlate the work intensity of a vehicle to the level of wear experienced by key components. For example, if a temperature sensor indicates that the component temperatures are rising at a higher than expected rate, but the overall level of productivity is not excessive, it could be concluded that an operator is using the truck very hard for a period and then sitting idle. To prevent overheating of the vehicle, the warehouse communications system can limit both the acceleration and maximum speed of the truck. The truck operation parameters, such as speed and acceleration, can also be limited to control energy consumption of the vehicle, and to promote "green" truck usage.

Similarly, if the battery state of charge is low near the end of a shift, the warehouse communications system can limit the acceleration and maximum speed of the vehicle to delay the need for recharging the battery. Based on inventory data, if the "fragility" a load is known, the acceleration and speed of the vehicle can also be limited accordingly. On rental fleets, truck operational parameters could be limited when payment is not received in a timely manner.

Additionally, control of the vehicle can be used to provide "zoning" for the vehicles. Using location data based on input, for example from the wireless access points 106, a GPS receiver 68, a beacon mounted in a particular location, or other input, a virtual geographical area can be defined for vehicles in use, to assure that vehicles follow approved routes. If a designated boundary is crossed, a notification with a time, date and location stamp can be recorded by the warehousing control system. This data can be used to monitor operators. Alternatively, the warehouse computer system can turn off the vehicle, or limit the maximum speed or acceleration when a boundary line is crossed. The display 55 inside of the vehicle can also be used to provide an indicator to the operator when approaching or exceeding a boundary. This system can be used to assist in preventing trucks that are too tall from going into an area with low ceiling or door heights, to keep unqualified material handling vehicles out of an area that requires EE rated battery powered vehicles (as defined in Underwriters Laboratory standard UL 583), or to keep unqualified material handling vehicles out of cold storage area.

Similarly, the acceleration and speed of the vehicle may be limited based on operator feedback. During a training period of an operator, the warehouse computer system 104 may limit the speed or other functions of the vehicle on which such an operator is logged on. OSHA check list data corresponding to the operator of the vehicle can also be used to prevent a specific operator from using a vehicle.

The warehouse computer system 104 can also provide a signal to lock the truck out of commission entirely. For example, when a truck requires service, the truck can be locked in the off position until activated by authorized service personnel.

Because of the access to the display in the vehicle, the internal display can also be used by the warehousing system. For example, warehouse service bulletins could be transmitted to the display. As described above, if service is required, the truck could also be locked in position, or the operation of the vehicle intentionally degraded until service is performed. The vehicle controller 12 could then send out a signal indicating that a service bulletin has been completed. The vehicle controller could also tracks how long maintenance took, and send that information when maintenance has been completed, thereby also providing a means for tracking the efficiency and effectiveness of service and maintenance operations.

Additionally, messages can be sent from the warehouse computer system 104 to the display to alert operators to conditions in the warehouse/factory, such as a spill in an aisle. This information could also be tied into alarms such as fire or chemical release alarms. The operator may have to perform an action, such as pressing a dedicated button to acknowledge receipt of the message. Paging messages, news blurbs, and other information could also be written to the display in the vehicle from the warehouse communications system, or from another computer connected to the warehouse communications system.

Similarly, when a software update is required, the software update can be transmitted to the entire fleet of vehicles, or only those with a particular version of software, based on data in the database 110. Additionally, the warehouse computer system could be used to configure or reconfigure the software in a selected or a fleet of trucks 10.

Other commands could be broadcast to the vehicles from the warehouse computer system 104. For example, a maintenance reminder could be set individually on vehicles in the fleet, or for all vehicles simultaneously. When maintenance is complete, the vehicle controller 12 can send a signal back to the warehouse computer system to reset the maintenance clock.

Additionally, dedicated actuators or buttons in the vehicle, or an existing actuator, such as a horn button, could be dedicated by the vehicle controller to provide a signal to the warehouse computer system 104 for activating another function, such as opening an overhead door, an entry to a freezer, or other devices. Here, it would be preferable to combine the function with a device that can correlate the location of the vehicle with the activated device. Thus, for example, the overhead door would be activated when the signal strength of the wireless devices indicate that the vehicles is near the overhead door, and the actuator is turned on.

Because of the amount of data stored in the database 110, it is also possible to simplify service procedures. For example, a service technician could be alerted via an email to his or her cell phone that a vehicle at a customer's site has broken down. The email would contain the vehicle serial number, its location, its battery state of charge and any fault codes that were generated prior to it breaking down. The technician could then use a local computing device, such as a laptop to access the database and retrieve the vehicle's entire operating history, including its as-built bill of materials and any parts that have been replaced since it was placed in service. Also the service technician can retrieve any service bulletins for that particular vehicle model. In addition, the operating history can be retrieved to see if the particular fault codes have appeared prior to the vehicle break down. He or she can also check if there were any impacts involving the vehicle which may have contributed to the break down.

Once the service technician has collected all this information remotely, the debugging process can start even before she is at the customer site. If service parts may be needed, she can query the parts inventory in her service van or at the dealer. She can also review the service manual stored on her laptop for diagnostics. Then at the material handling vehicle in the customer warehouse, the service technician can connect her laptop directly to the vehicle fleet manager. The laptop then becomes a direct debugging tool to further diagnose the problem.

Upon completing the maintenance or repair work, the cost of that work is entered into the warehouse computer system 104 either directly or via the user input 67 on the material handling vehicle 10. The cost and information about the type of maintenance or repair work performed is stored in the storage section 83 of the warehouse computer system 104. That data also is sent through the Internet link 108 to the warehouse management computer system 114 and the vehicle manufacturer's computer system 112. This enables the cost of operating each material handling vehicle to be monitored, as will be described in greater detail.

Various other functions can also be provided by the present invention. For example, when the warehouse computer system determines that a vehicle is out of service, or is likely to be out of service due to detected problems or a need for a recharge the vehicle, critical work can be reassigned to other vehicles in the fleet, thereby improving efficiency and limiting downtime.

The vehicle information system 100 can also determine which vehicles in a fleet are operating at better levels of efficiency than other vehicles based on operating parameters, driver skill, and material transportation dynamics. Some types of material handling vehicles work better at horizontal transport, others at putting loads in a rack or taking them down. Some excel at order picking, both at high and low levels. In a given warehouse, the dynamic needs for moving materials may change hourly. The computing system can assign or reassign vehicles to certain tasks and improve throughput as conditions develop.

Another benefit of gathering the operational data from the plurality of material handling vehicles 10 operating in the warehouses 101 is that the data can be compiled in a number of different manners to present the warehouse management with useful reports, graphs and tables showing current vehicle usage and future needs. That compilation is performed by a vehicle information reporting system implemented by software executed by the warehouse management computer system 114 or the warehouse computer system 104 depending upon where the warehouse management personnel are located. This enables the managers at a specific warehouse 101 to review the material handling vehicle operations at that facility and also enables the corporate executives at the company headquarters to analyze material handling vehicle operations for the entire company. Only designated people can access to the vehicle information system based on an assigned username and password and each designated person's access can be restricted to only certain sections of the system. For example, a manager at one warehouse may be limited to viewing data and reports for activity at only that specific warehouse, whereas an executive at the warehouse headquarters is able to access information for all the facilities of the warehouse company. In another example, a vehicle maintenance worker may be able to access vehicle performance information, but not information related to vehicle operators. The management of the company can set policies regarding the types of employees who may access certain kinds of information.

Figure 8:
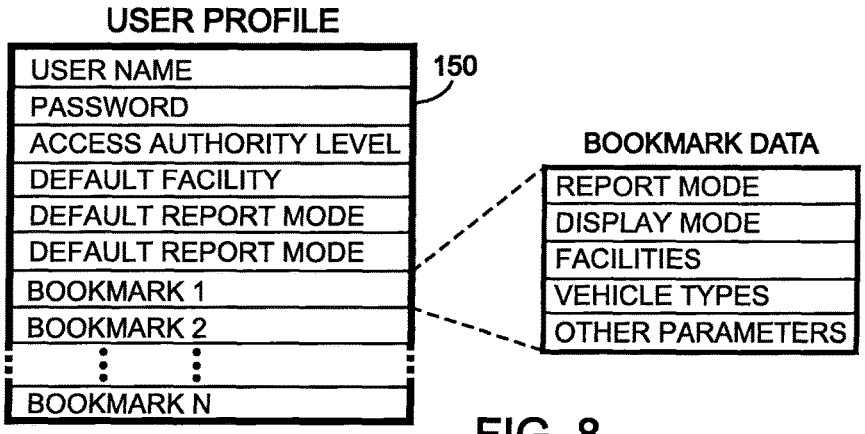
FIG. 8 graphically illustrates the data of a user profile that is stored in the warehouse computer system.

With reference to FIG. 8, the vehicle information reporting system stores a user profile 150 for each person who has authorized access. The user profile, in addition to defining the person's username, password and access authority level, also contains configuration information that the associated user is able to set. The configuration information specifies certain preferences for that particular user, such as the format and kinds of data to be used in each of the different types of report modes, as will be described.

The vehicle information reporting system processes and displays the gathered vehicle data in an interactive form with graphs and charts that show actual performance and predictive trends based on that performance. An unrestricted user is able to filter the data presentation so as to show data from all or selected ones of the company facilities, types of material handling vehicles, types of vehicle events, and operator performance. The user is able to navigate through the different display formats utilizing display tabs and check list type menus. In addition, an overview display mode provides a concise understanding of the operating state of the material handling vehicles during a selected period of time, thereby enabling a synopsis comparison of vehicle operation among the different facilities and types of material handling vehicles. The system also provides trend information which is used by management personnel to predict future material handling vehicle needs. For example a trend chart may show that the time of use of the vehicle fleet is increasing to a point at which acquisition of additional vehicles is required.

In order to fully appreciate the full capability of the vehicle information reporting system, its use at the warehouse company headquarters, and specifically the data analysis and report display on the warehouse management computer system 114 will be described. It should be understood that the warehouse computer system 104, manufacturer computer system 112, and the dealer computer system 116 also are able to execute the information reporting system, however the particular types of data that these other computer systems may access can be limited by selectable configuration of the software. For example, operation at the warehouse computer system 104 may be limited by the company to accessing only information for the respective warehouse, and the manufacturer and the dealer computer systems are restricted from accessing proprietary data of the warehouse company and its employees.

Figure 9:
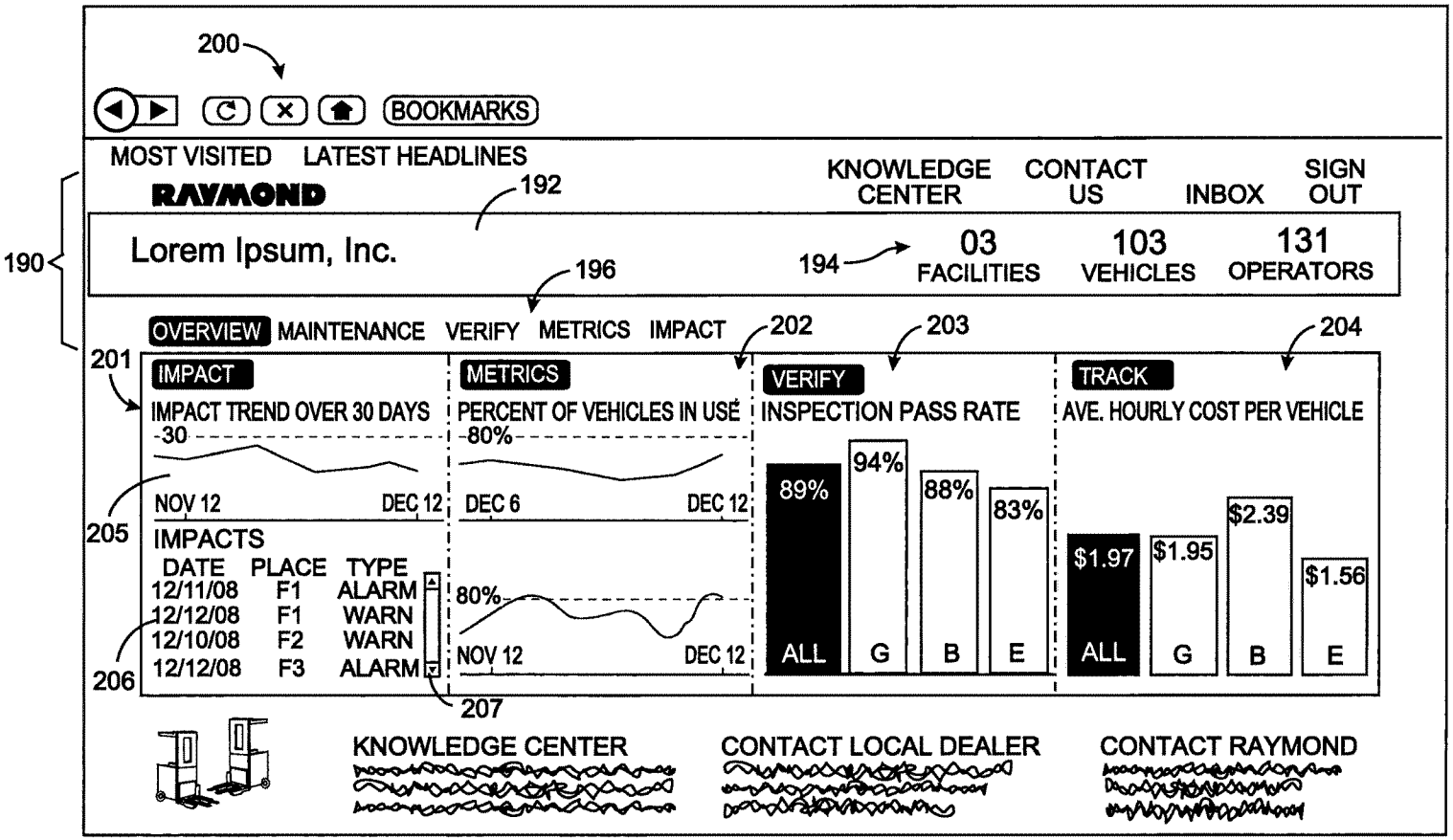
FIG. 9 depicts an exemplary display on a monitor screen of the warehouse computer system presenting a report created by vehicle information reporting system from operational data gathered from the material handling vehicle.

FIG. 9 illustrates the primary screen display 200 of the warehouse computer system 104 executing the vehicle information reporting system in the overview report mode in which cumulative information for all the facilities of that company is displayed. A conventional toolbar 191 is provided at the top of the display and contains icons similar to those in a web browser for navigating between screens and sections of the information reporting system. A header 190 is the same for many of the display modes and provides generic information and specialized tools for navigating among the different display modes. The header 190 has a banner 192 that identifies the company operating the material handling vehicles and in section 194 specifies the number of facilities, the number of vehicles, and the number of operators for which data has been compiled. The facilities of the exemplary company are warehouses, however the information reporting system can be used at companies with other kinds of facilities. By placing the cursor over the region designating the number of operators and then clicking the mouse, brings up a screen that enables the user to access information about those operators, listed hereinafter, and alter that information. A similar method can be used to select information about the vehicles counted in this section 194.

The lower portion of the header 190 has a set of tabs 196 identifying five different report modes of overview, maintenance, verify, metrics, and impact. A fewer or greater number of report modes may be provided. The user, by placing the cursor on a particular tab and clicking the computer mouse 93, selects the associated report mode. The currently active report mode (e.g. overview) is highlighted in reverse video or with a different background color. The primary portion of the display screen beneath the set of tabs 196 is used to present the report information and has a content that varies depending on the selected report mode and the information desired by the user.

In the overview report mode display 200 depicted in FIG. 9, the primary section of the screen is divided into four sections 201, 202, 203 and 204, one for each of the four other report modes, i.e., maintenance, verify, metrics, and impact. If more that four other report modes are provided, the user is able to designate which four of the report modes are to appear in the four sections 201-204 of the overview report mode display 200. Thus the four reports modes that are most relevant to that particular user will be displayed. As an alternative, the user can shrink the size of the sections so that the overview report mode display contains section for five report modes. The configuration parameters of the overview report mode display 200 for a given user are stored with other settings in that person's user profile and the next time that person accesses the vehicle information reporting system, the display will be configured in the same manner defined in that user profile. The user also has the ability to customize the default date range shown for each of the sets of information shown on the overview page.

The first section 201 for the impact report mode presents information regarding incidents where a material handling vehicle collided with an object in an abnormal manner. This first section 201 provides a line graph 205 showing the number of impacts that occurred each day throughout a one month period at all of the facilities of the company. A dashed line on the graph denotes the level of 30 impacts. Beneath the graph is a list 206 of the reported impacts in which the date and time, the facility, and the impact severity level (warning or alarm) of each impact is noted. A scroll bar 207 enables the user to move up and down through the list.

The second section 202 of the overview report mode display corresponds to the metrics report mode and displays data about material handling vehicle usage during a seven day reporting period. This second section 202 contains an upper lines graph of the percentage of material handling vehicles in use during each of those days and a lower graph showing vehicle usage trend over the previous thirty days. Both of these graphs compare the actual usage to a desired goal of 80% usage as defined by a user and indicated by a dashed line on each graph.

The third section 203 of the overview report mode display provides data about the percentage of material handling vehicles that passed occasional inspections during a specified period. In the United States such inspections are mandated by the U.S. Occupational Safety and Health Administration. The bar graph in this section has separate bars that indicate the aggregate inspection pass percentages for the entire company and for each of its three facilities, e.g., warehouses in the municipalities of Greene, Binghamton, and Endicott.

The fourth section 204 of the overview report mode display 200 is related to the maintenance report mode which manages maintenance and service of the material handling vehicles and tracks the related costs. The costs of parts and labor expended for each vehicle and other selected operating costs are tabulated and reported on a warehouse and a company wide basis. The fourth section 204 also provides the user access to vital information such as best practices, special warranties, vehicle specifications and repair contact information. This display section contains a bar graph showing the average cost per hour of operating all the material handling vehicles at the company and at each of its three facilities during the previous seven days.

Along the bottom of the overview report mode display 200 are areas that provide a link to the vehicle manufacturer's information knowledge center in the database 110 (FIG. 6) and contact information for the local dealer and the vehicle manufacturer. By placing the cursor over one of these areas and clicking the computer mouse 93, the user is linked to the related Internet site.

On the overview report mode display 200, the user can click the mouse when the cursor is on one of the primary tabs 196 to access more detailed information in each of the other report modes, e.g., the impact, metrics, verify, and maintenance report modes. For example, clicking on the word "impact" causes the warehouse computer system 104 to transition into the impact report mode and specifically the summary display mode 210 shown in FIG. 10. The same transition can occur by the clicking the mouse when the cursor is in the associated first section 201 of the overview report mode display. If the user selects a circle that represents a facility (or vehicle type, depending on mode of comparison), the circle will 'split apart'. For example, if a facility circle is selected, the chart will change to show circles for each of the vehicle types available at that facility (and that are selected in the filters area). The circles would be plotted based on the number of impacts.

Figure 10:
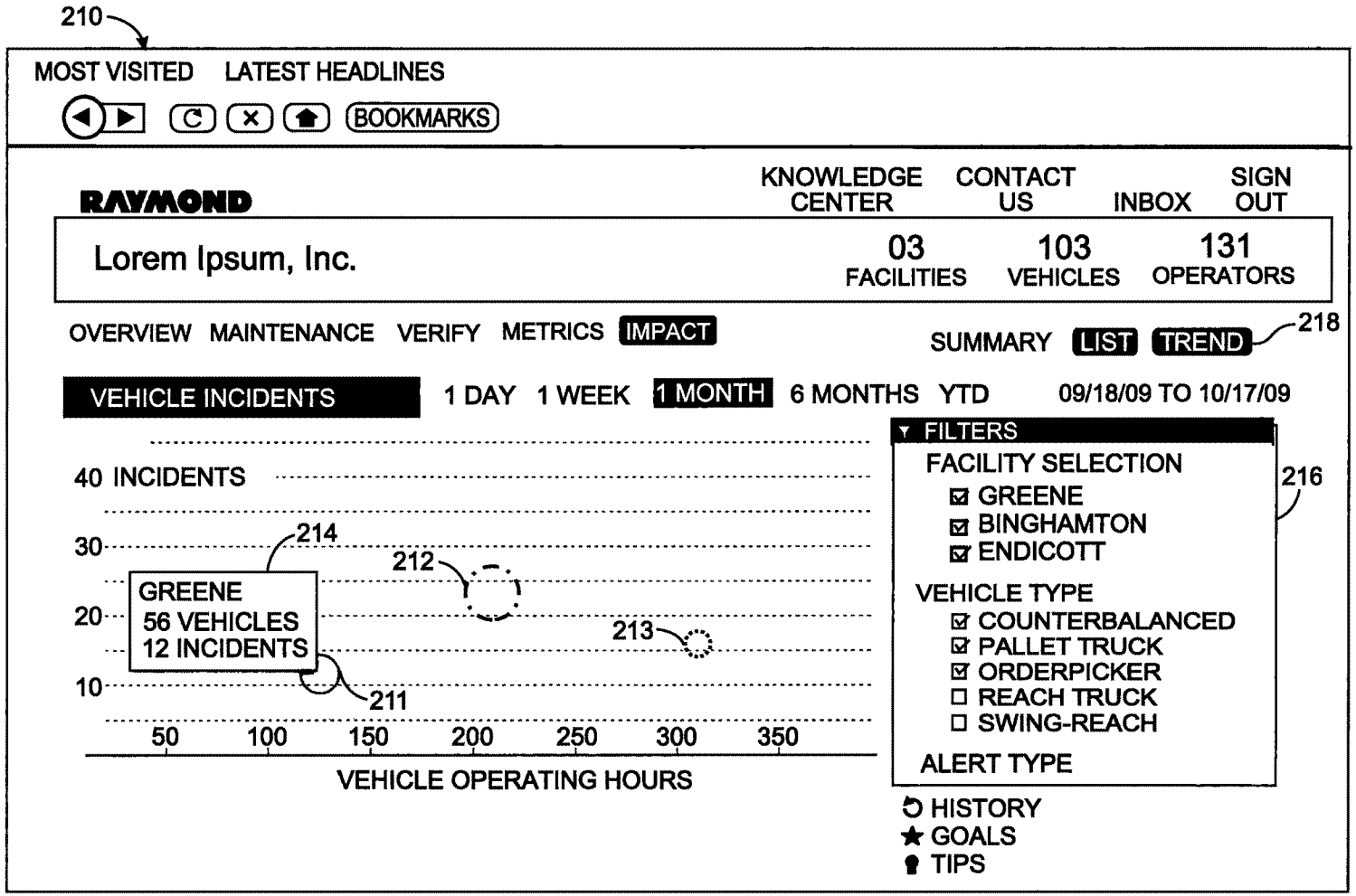
FIG. 10 is an illustration of the computer display screen presenting data regarding vehicle impacts with an objects at several warehouses.

The screen in FIG. 10 presents data regarding material handling vehicle collisions at each of the three warehouse facilities on a graph showing the number of impacts versus the aggregate number of vehicle operating hours during a defined report period. Each circle 211, 212 and 213 on the graph corresponds to the impact data for one of the three facilities with the circle being color coded to identify the respective facility as indicated in a menu 216 on the right side of the impact report display screen. The relative size of each circle corresponds to the number of impacts per vehicle operating hour and thus provides an immediate visualization of the relative number of impacts at each of the three facilities. Placing the computer cursor over a given circle causes a box, such as box 214, to appear that has information which identifies the facility and provides a detailed summary of the impact data represented by that circle. By clicking the computer mouse 93 on regions at the bottom of the box 214, the display transitions to one containing information about each reported impact or to a display showing trends of the vehicle impacts for the associated facility.

A menu 216 on the right side of the impact summary display mode 210 permits the user to select data from different combinations of one or more of the facilities and different combinations of types of vehicles to include in the displayed report. Breaking the data down by vehicle type enables the user to identify whether a particular type of vehicle is more impact prone. In this example, the list contains vehicle impact data for counterbalanced, pallet and orderpicker type vehicles at all three facilities. The data also may be filtered by selecting a specific collision intensity level ("warning" or "alarm") corresponding the impact severity.

Above the menu 216 are three labels 218 which enable the user to select the format of the impact report mode from among a summary display mode, depicted in FIG. 10, a List display mode that tabulates the collision data, or a Trend display mode with a graph of the collision data. By clicking the computer mouse 93 when the cursor is on the word "List" on the impact summary display mode 210, the display format transitions to the List display mode that presents information pertaining to each impact that satisfies the selection criteria in menu 216.

Figure 11:
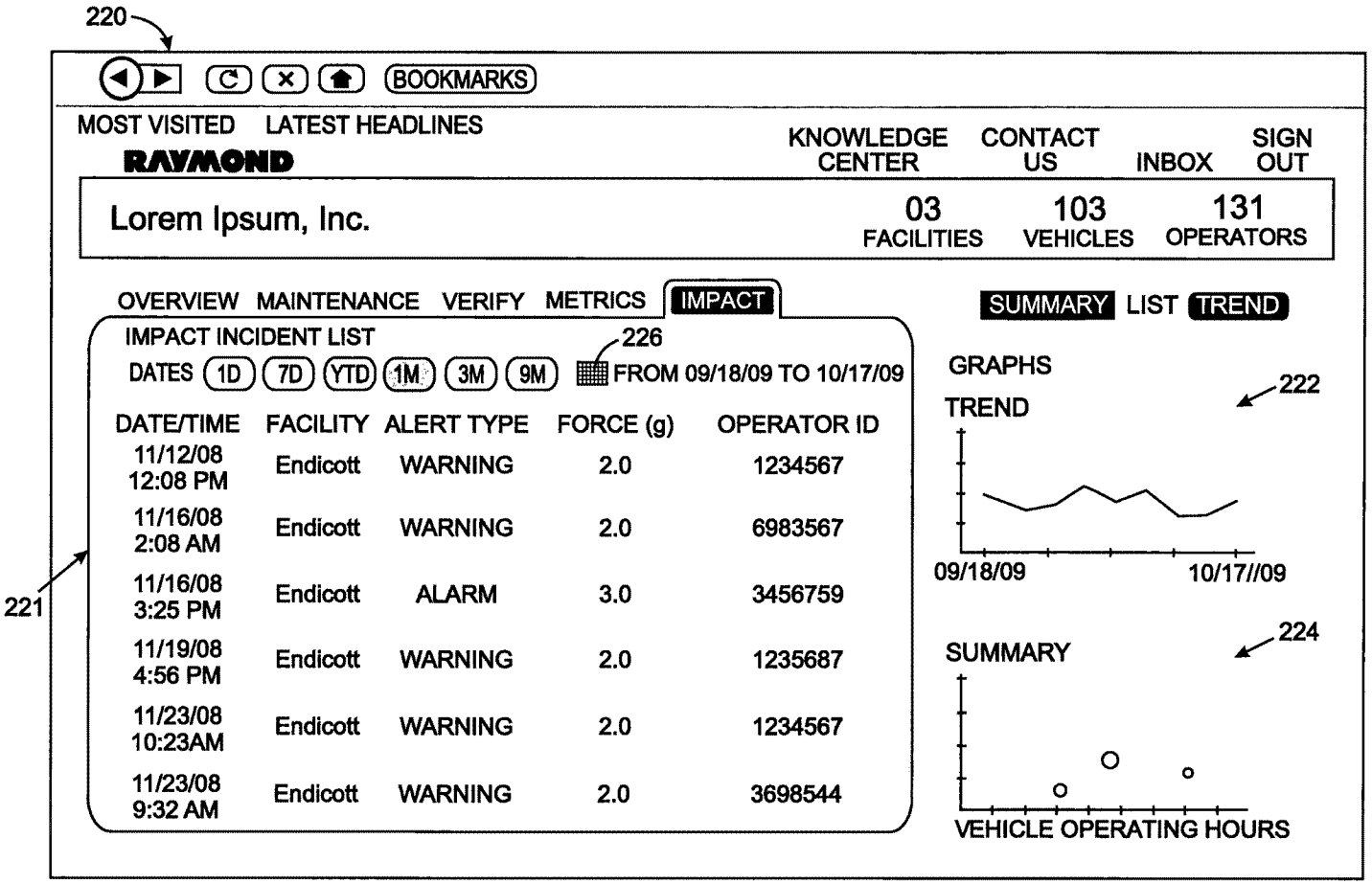
FIG. 11 shows a computer display screen listing detailed information about the each of a plurality of vehicle impacts.

Alternatively if the user in interested in the impact data for only one facility, the computer mouse is clicked while the cursor is placed over the corresponding facility circle 211, 212, or 213 on the summary display mode 210 of the impact report mode in FIG. 10. This causes execution of the vehicle information reporting system software by the warehouse management computer system 114 to transition to the List display mode 220 that tabulates the data for vehicle impacts at the selected facility, for example as shown in FIG. 11. In this case, a table 221 of impacts at the Endicott warehouse for the defined one month period, e.g., Sep. 18, 2009 to Oct. 17, 2009, which is user can change by clicking the mouse 93 on this area to activate a pop-up date selection box 226. For each impact, the date and time of the event is indicated along with the facility identification and the alert classification, i.e., whether it is a warning or an alarm collision intensity level. The actual force of the impact, as detected by sensors on the vehicle, is displayed along with identification of the operator who was logged onto the vehicle at the time of the impact.

By clicking the mouse 93 on one of the listed impacts more detailed data about that collision will be presented in another display mode. That new information includes an identification of the material handling vehicle that was involved which similarly can be selected by a mouse click to display a file of information about all the collisions involving that particular vehicle. Also from the impact List display mode 220, the user can click the mouse 93 on an operator identification to view the vehicle operating record and other information for that specific operator. That operator information includes some or all of the items listed in Table 2.

TABLE 2

| OPERATOR INFORMATION |
|---|
| Name |
| Employee identification number |
| Primary location of employment |
| Department of the company |
| Job title |
| Date hired |
| Human resource information |
| Salary |
| Benefits |
| Payroll taxes |
| Number of years certified as lift operator |
| Certifications, licenses & credentials |
| Performance reviews |
| Miscellaneous Notes |
| Work schedule & vehicle assignments |
| Timesheet |
| Vehicles operated and the days/times operated |
| Incident reports |

TABLE 2-continued

| OPERATOR INFORMATION |
|---|
| Vehicle impacts |
| Other activities |
| Vehicle operation parameter limits |

Thus the computer system user is able to easily drill down from a high level display summarizing impact data for the entire company to successive levels of more detailed information. This drill down feature is available for the other report modes, described hereafter.

On the right side of the impact table 221 in FIG. 11 is a graph 222 of the trend of the selected impact data through the designated one week period. It should be understood that the user is able to define other time periods using the date selection box 226. Beneath that graph 222 is a small replica 224 of the graph from the impact summary display mode 210 showing the cumulative data from all the company facilities. Each user is able to customize a default presentation layout for the impact mode by specifying which of the three views options—survey, list and trend—is to be shown in each area 221, 222 and 223. The default presentation layout also can be individually defined for each of the other display modes—maintenance, verify, and metrics.

Figure 12:
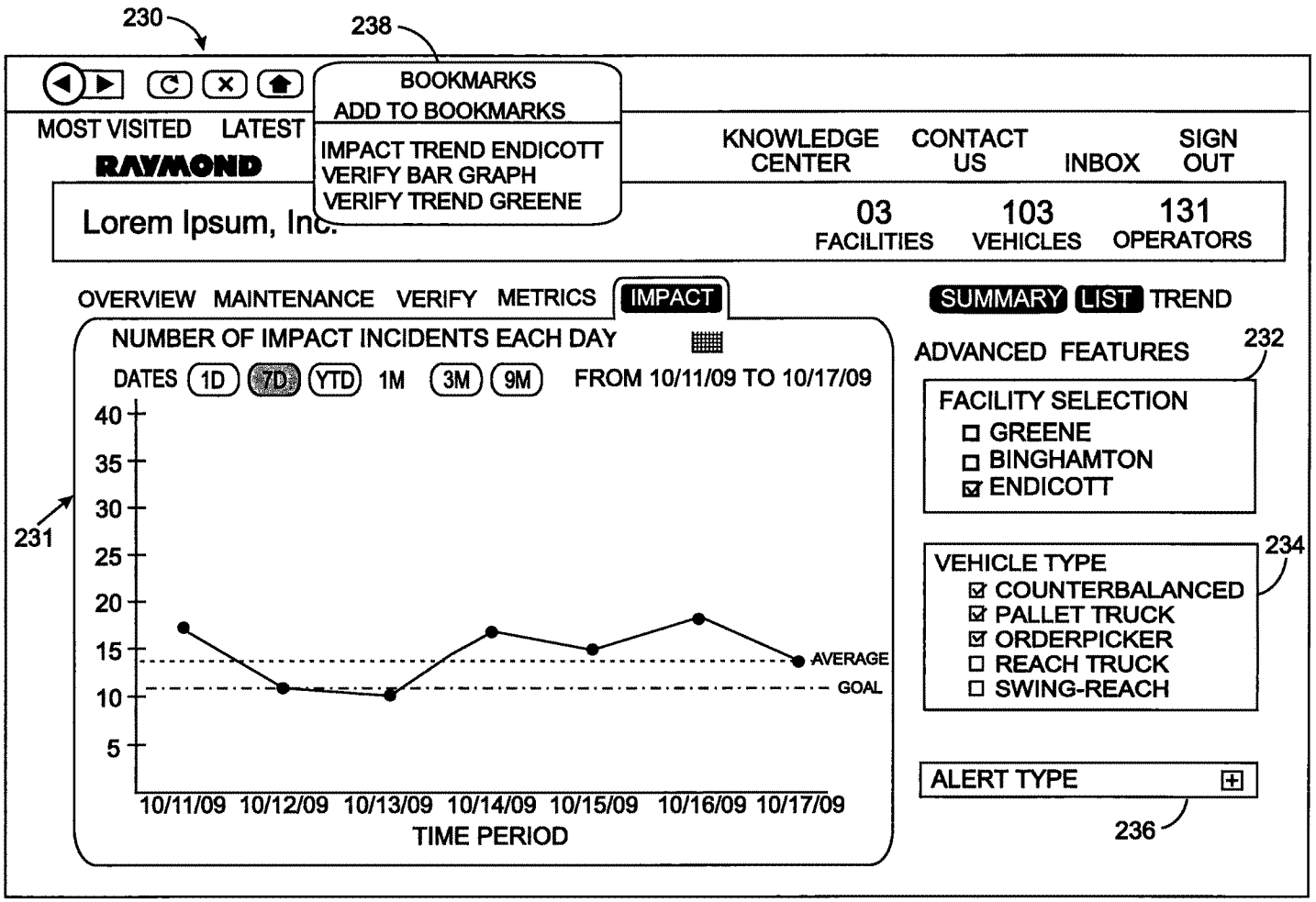
FIG. 12 depicts a computer display screen showing trend data regarding the number of vehicle impacts at one warehouse over a period of time.

Clicking the mouse 93 on the trend graph 222 or on the Trend button there above uses a transition to the trend display mode 230 depicted in FIG. 12. The trend display mode provides an enlarged graph 231 indicating the total number of impacts at the Endicott warehouse for each day during the indicated time period. Buttons along the top of the graph are used to select the time period represented. A dashed line indicates the average impact level during the display period and a dashed-dotted line denotes a goal for the number of impacts at this warehouse. The goal for this operational parameter is defined by a user who has been granted the authority to do so, i.e. a manager at the company headquarters. That authority appears in the particular user's system profile and the software for the vehicle information system prevents unauthorized persons from changing the goals. As an alternative to a single goal level, upper and lower goal levels can be specified, thereby defining a range of acceptable values for the displayed parameter. The vehicle information reporting system also can be configured so that when the value of the associated parameter is outside that goal range defined, an email with a prewritten text is automatically sent to one or more previously designated recipients. The graph also can be configured to filter, or limit, the presented information to that from one or more of the facilities, based on the selection made by the user from the menu 232 on the right of the display. Similar, menus 234 and 236 are provided for respectively limiting the presented data selecting one or more vehicle type or a particular impact alert type. The selections on those menus 232, 234 and 236 may be designated by the system defaults or in the user profile for the person accessing the system. The user may be able to alter manually the selections on those menus provided that doing so does not conflict with a restriction to that person's authority. For example, a person whose access authority is limited to information from only one specific warehouse may not alter the filter to view data from another warehouse. When a particular report is being displayed, the user may bookmark that display and thus its graph type and filter configuration by pulling down the bookmark list 238 and clicking the mouse cursor on the add bookmark entry. Subsequently, when the user desires this same report configuration, it can be selected from the bookmark list 238. The bookmarks are stored in the user profile 150 as depicted in FIG. 8.

Figure 13:
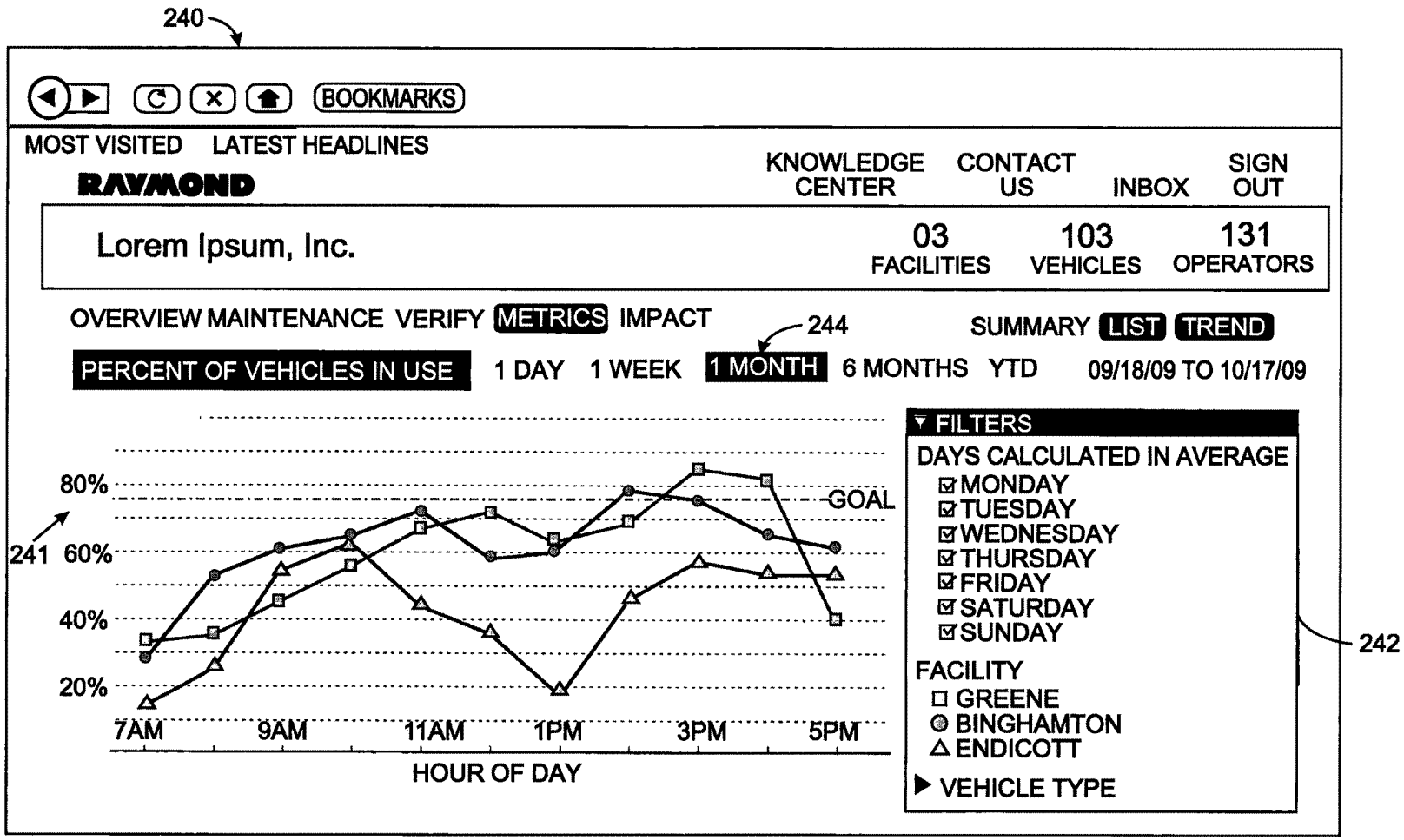
FIG. 13 illustrates a computer monitor displaying a graph of the percentage of the material handling vehicles used at each hour of the work day averaged over a one month period.

FIG. 13 illustrates the summary display mode 240 for the Metric report mode which provides measurements of the utilization of the material handling vehicles, thereby indicating how efficiently the fleet of vehicles is being used. This screen display has an section 241 containing a graph that plots the monthly average percentage of vehicle used at each of the three facilities during operating hours (the operating hour parameters are set for each facility). If facilities have different operating hours, when more than one facility is selected for display, the graph range will be from the earliest start time to latest end time each day. The report can be configured not to count days that the warehouse is not in operation, such as Sundays and holidays, for example. This graph also illustrates the user defined usage goal level of 77%. Each data line represents the usage at one of the three warehouse facilities of the company. To the right of the graph section 241 is a menu 242 which allows the user to filter the displayed data for only certain days of the week, selected facilities, or selected vehicle types. The period of time over which the data are averaged also can be changed by selecting different tabs 244 along the top of the graph to designate either a single day, a single week, a single month or various numbers of months. These different data selection criteria filter the data gathered from all the vehicles so that the data are analyzed and graphically displayed to the user in a number of combinations. Other types of metrics can be calculated and reported, such as the numbers of deadman hours, lift hours, and travel hours of vehicle operation.

Figure 14:
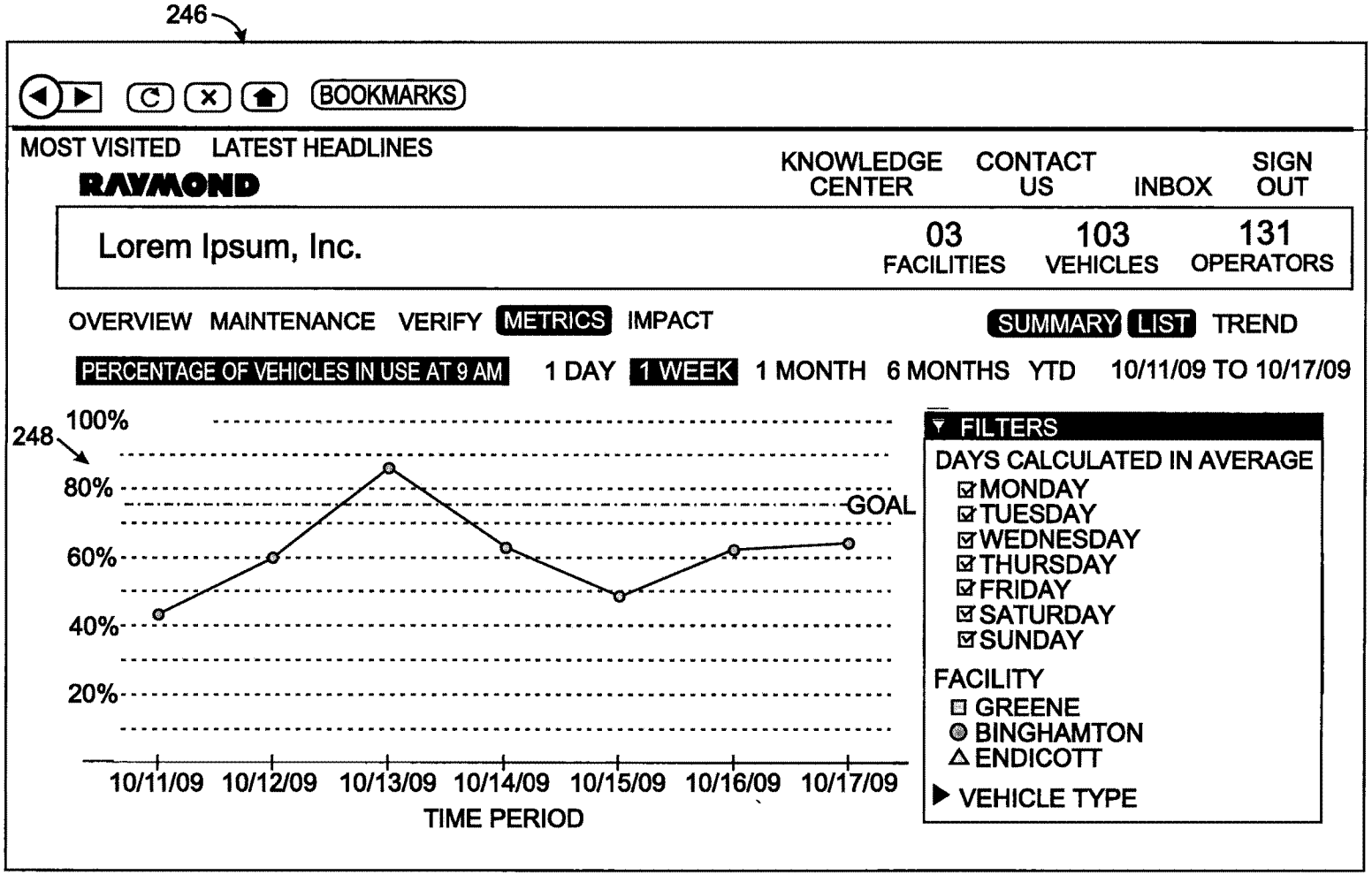
FIG. 14 shows the percentage of material handling vehicle fleet usage at one warehouse for each day of a one week period.

With reference to FIG. 14, the Metric report mode has another display mode 246 in which the percentage of the vehicle fleet that is in use at a designated time for each day of a specified week is displayed in graph 248. This enables supervisory personnel easily observe which days require more vehicles. This information is employed to plan various activities, such as vehicle maintenance or operator training on low use days.

At the commencement of each work day, every material handling vehicle 10 is inspected to determine whether it is in satisfactory operating condition. The inspections may be performed more frequently, such as at the start of each work shift. Any problem requiring maintenance or repair is reported through the warehouse communications system 102 and depending upon the nature of problems found, the vehicle may be removed from use until repairs are performed. Whether or not a given vehicle passes an inspection is recorded by the warehouse computer system and the data used in reports to the supervisory personnel.

There also is a list display mode (not shown) for the Metric report mode in which data for each particular material handling vehicle is displayed in a manner similar to that in FIG. 11 for the impact report mode.

Figure 15:
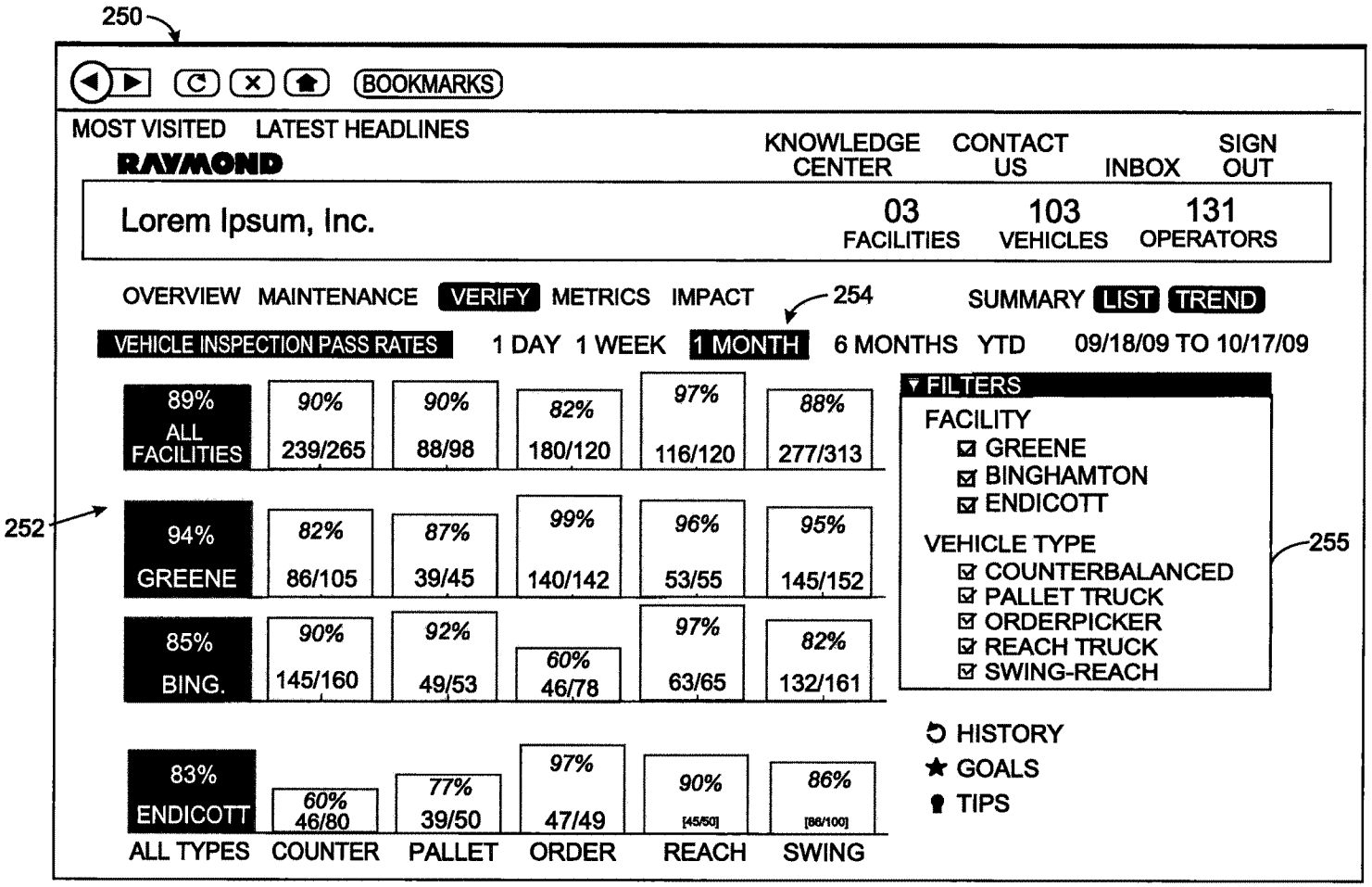
FIG. 15 is a depiction of computer display screen showing information regarding how many of the different types of material handling vehicles passed a pre-use inspection at several warehouses.

FIG. 15 illustrates the summary display mode 250 of the verify report mode indicating averages of the percentage of vehicles that passed the inspections each day or each work shift during a defined time period, e.g., one month. Different periods of time are selected by clicking the mouse 93 when the cursor is the associated one of the tabs 254 across the top of the chart. This screen display presents the inspection information in a series of bar charts 252. The top line of bar charts is a compilation of the data for all the company facilities with the blackened bar indicating the aggregate inspection information and each bar to the right thereof corresponds to the percentage of the different types of vehicles throughout the company that passed the inspections. The second, third and fourth lines of the bar charts 252 denote similar information for each of the three warehouse facilities. Thus the display provides data for the entire company and for individual facilities broken down by particular vehicle types.

A menu 255 on the right side of the screen of the verify summary display mode 250 enables the user to choose different filter criteria for selecting data for the display from certain ones of the facilities and certain types of vehicles.

Figure 16:
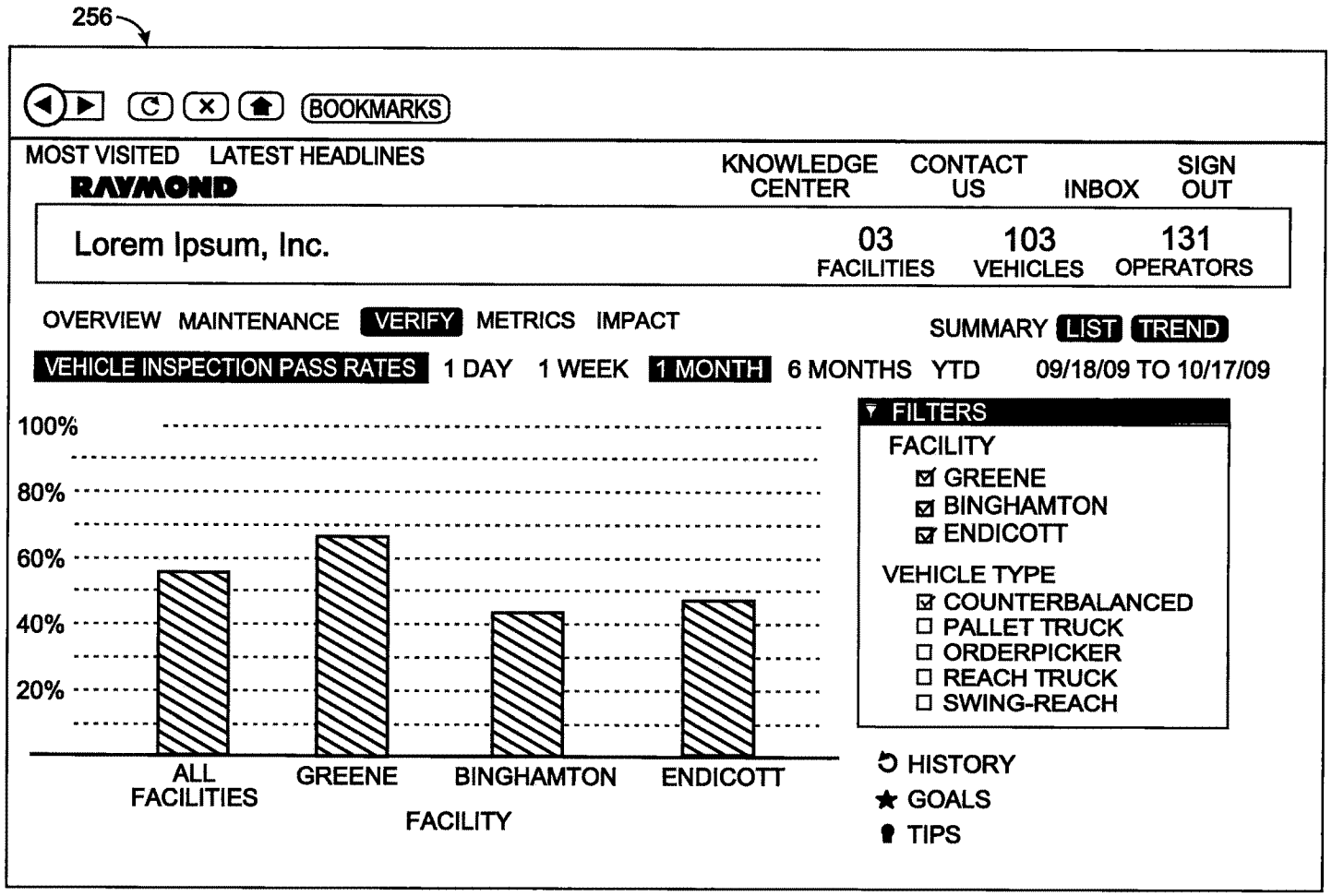
FIG. 16 is a computer display showing the percentage of one type of material handling vehicle that passed a pre-use inspection at several warehouses over a one month period.
Figure 17:
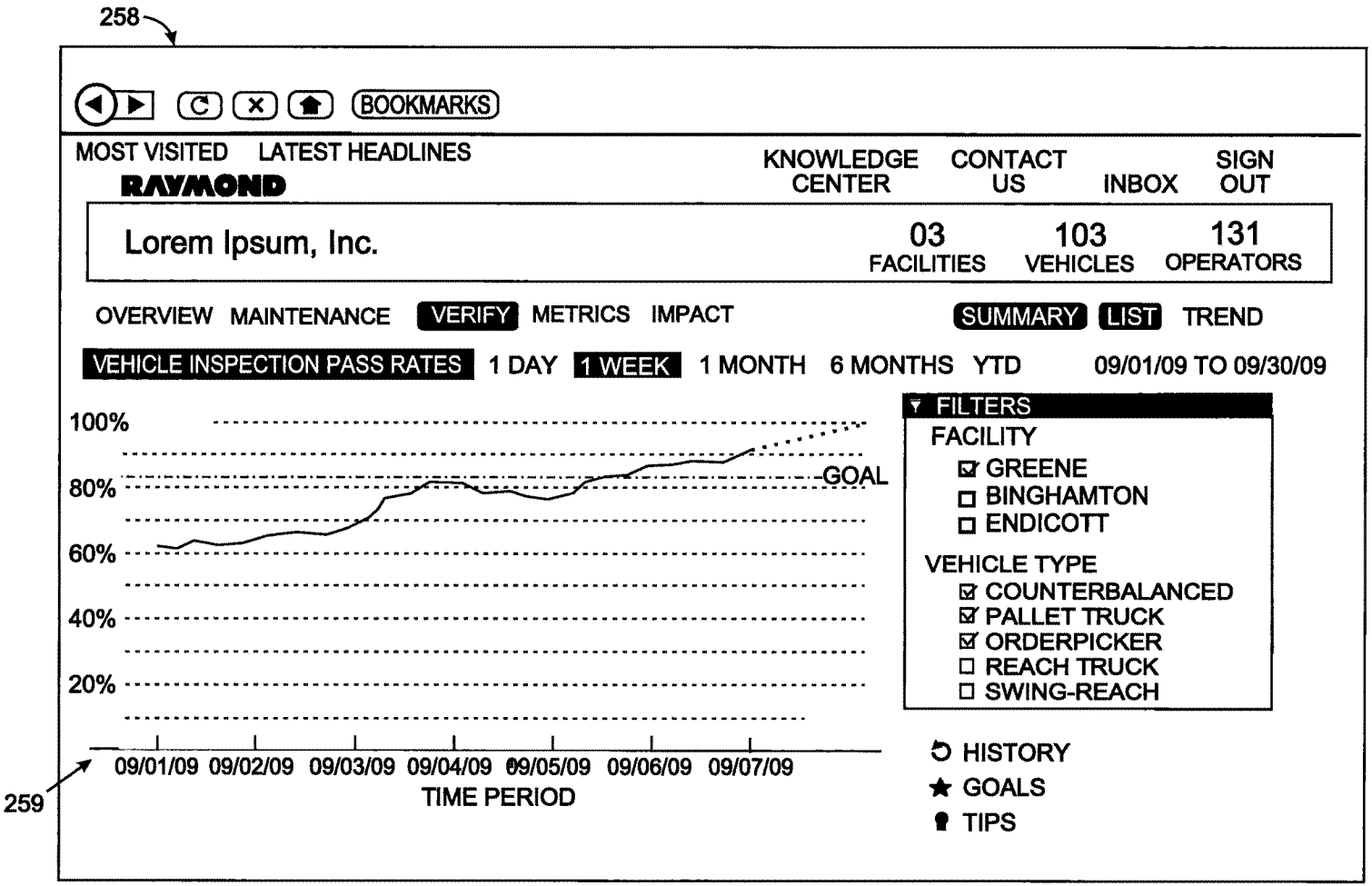
FIG. 17 is a computer display showing the percentage of material handling vehicle that passed a pre-use inspection at one warehouse each day of a one week period.

FIG. 16 illustrates another example of the summary display mode 256 of the verify report mode in which vehicle inspection data for only one type of material handling vehicle, i.e., a counterbalanced truck, is displayed. Here all the facilities have been selected and the graphical data presentation provides a separate bar that indicates the percentage of the counterbalanced trucks at each facility that passed the inspections during the designated period and another bar indicates the overall counterbalanced truck inspection data for the entire company. This summary display mode 256 facilitates comparing the inspection data for one type of material handling vehicle among the different warehouse facilities.

FIG. 16 depicts the computer screen in the trend display mode 258 of the verify report mode that presents information regarding the inspection pass rates for several types of material handling vehicles at one of the facilities. This display mode is in the form of a graph 259 that shows a generally upward trend in vehicle use. Actual recorded data are depicted by the solid line on the graph and the vehicle information reporting system has projected the trend into the future as depicted by the dotted line after the end of the period that terminated on Sep. 30, 2009 in this example. This trend graph enables supervisory personnel easily observe changes in the vehicle use over time and predict future use based on the recently recorded data assuming that the current trend continues. The warehouse management also has defined a goal level of vehicle use, e.g. 82%, for the facility for which the data are displayed and that goal level is indicated by the dashed and dotted line on the graph 259. As with the previously described display modes, the trend display mode 258 has elements that are selectable by the user to define different periods of time for which the data are displayed.

There also is a list display mode (not shown) for the verify report mode in which data for each particular material handling vehicle is displayed in a manner similar to that in FIG. 11 for the impact report mode.

Figure 18:
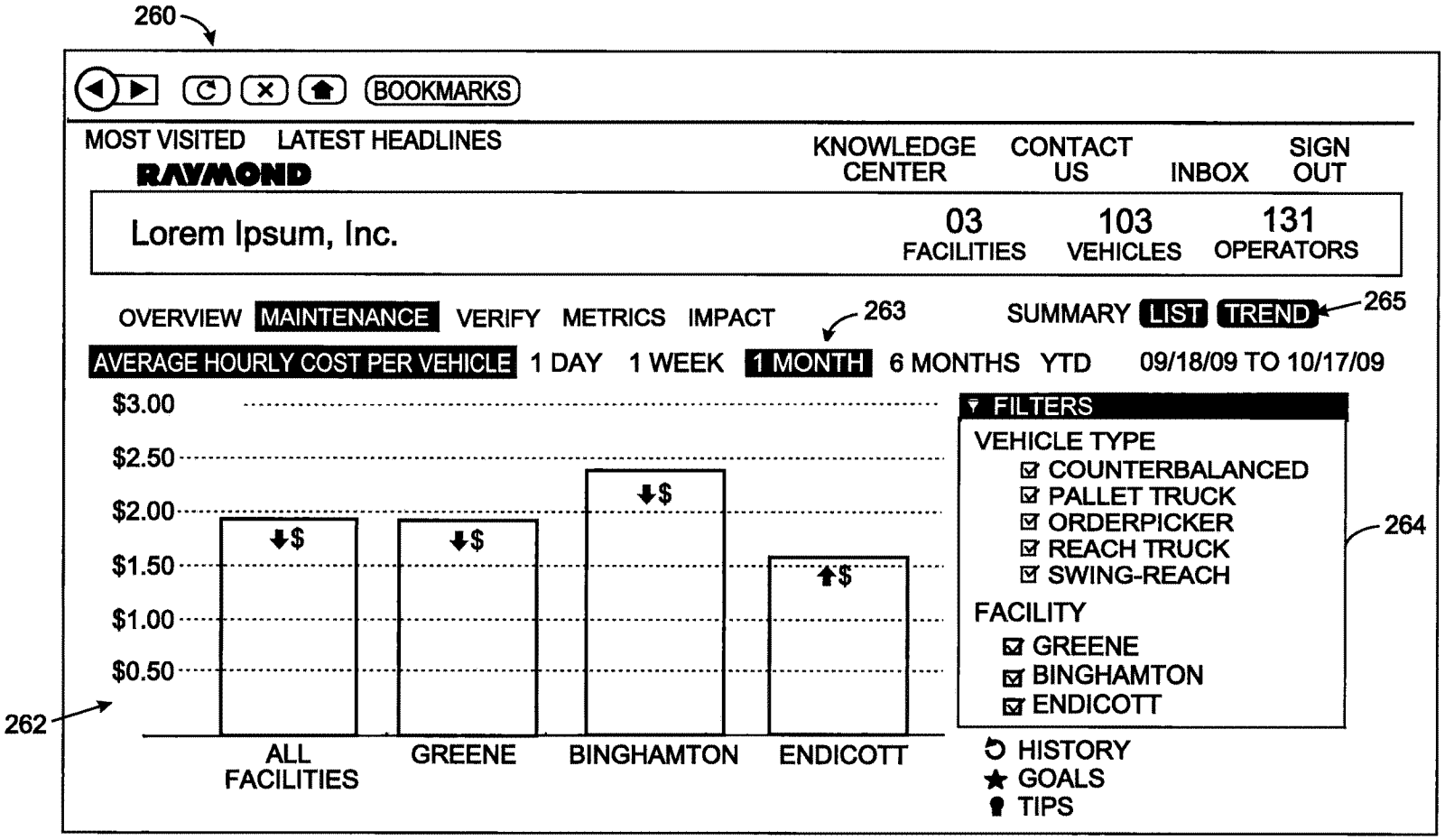
FIG. 18 illustrates a computer display screen presenting data pertaining to operating costs for the material handling vehicles at three different warehouses.

FIG. 18 illustrates the summary display mode 260 for the maintenance report mode in which vehicle operating cost information is presented to the user. The summary display mode provides a graph 262 with individual bars indicating the average operating cost per hour for all the material handling vehicles in the company and at each of the three warehouses. In area 263 of the display, the user is able to select different time periods over which the data are averaged. The menu 264 allows the user to select data for all the material handling vehicles or different combinations of one or more types of material handling vehicles to utilize in preparing the graph. Also if there are more facilities than can be displayed at the same time on the graph 262, specific facilities can be selected on the menu 264 for display. Other tabs 265 are provided on the monitor screen in the summary display mode 260 to transition to the list or trend display modes for the maintenance report mode.

Figure 19:
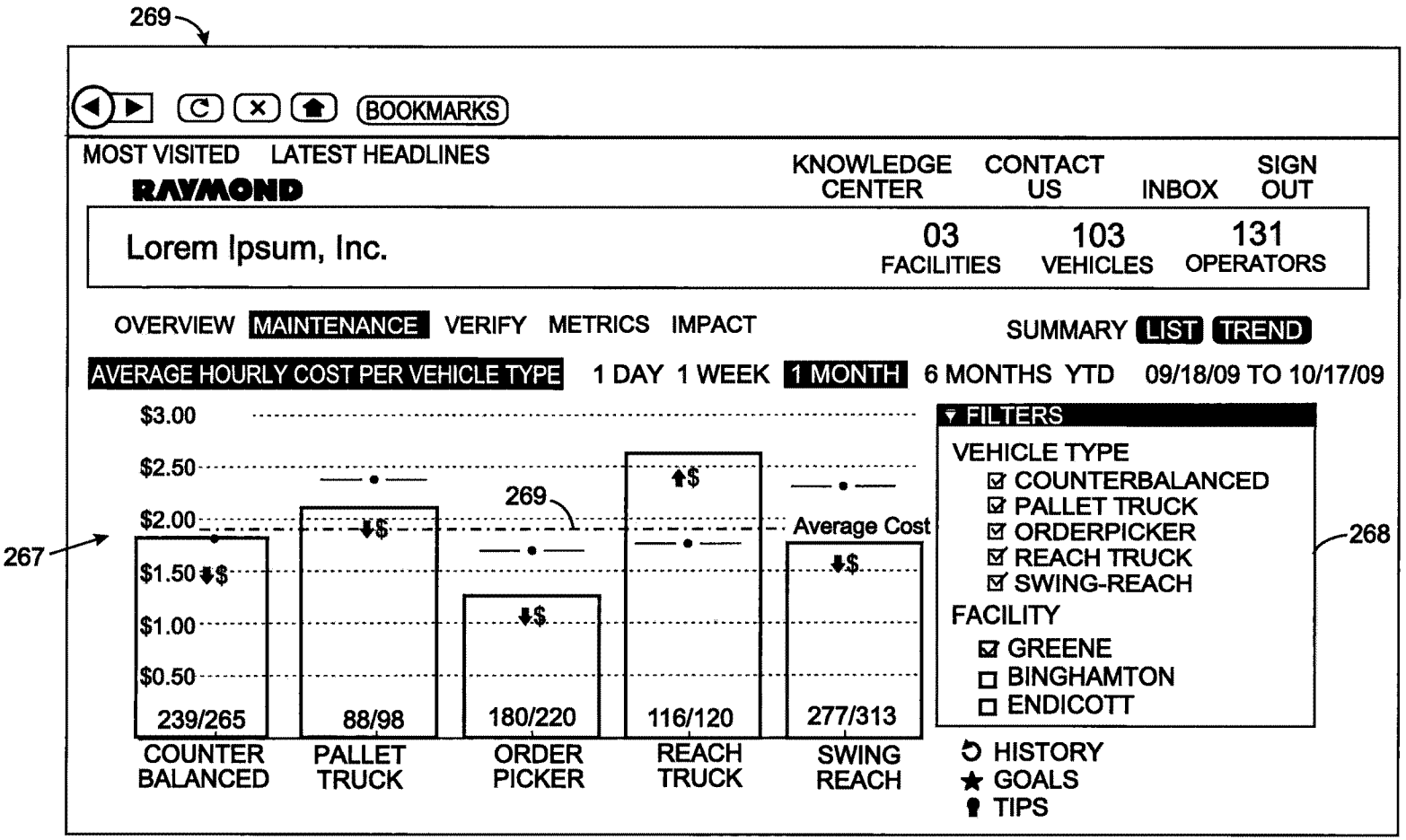
FIG. 19 illustrates a computer display screen presenting data pertaining to operating costs for different types of material handling vehicles at one warehouse.

FIG. 19 depicts an example of the summary display mode for the maintenance report mode in which, as designated in the menu 268, data for all the types of material handling vehicles at one facility. This summary display mode 266 contains a graph with a separate bar for each type of vehicle thereby providing a comparison of the relative cost per hour of operating each type. A dashed and dotted horizontal line 269 denotes the average hourly operating cost for all the material handling vehicles at the selected facility. As with the other display modes, the user is able to select the time period over which the data are to be processed. The user can select other facilities and different combinations of vehicle types on the menu 264.

Figure 20:
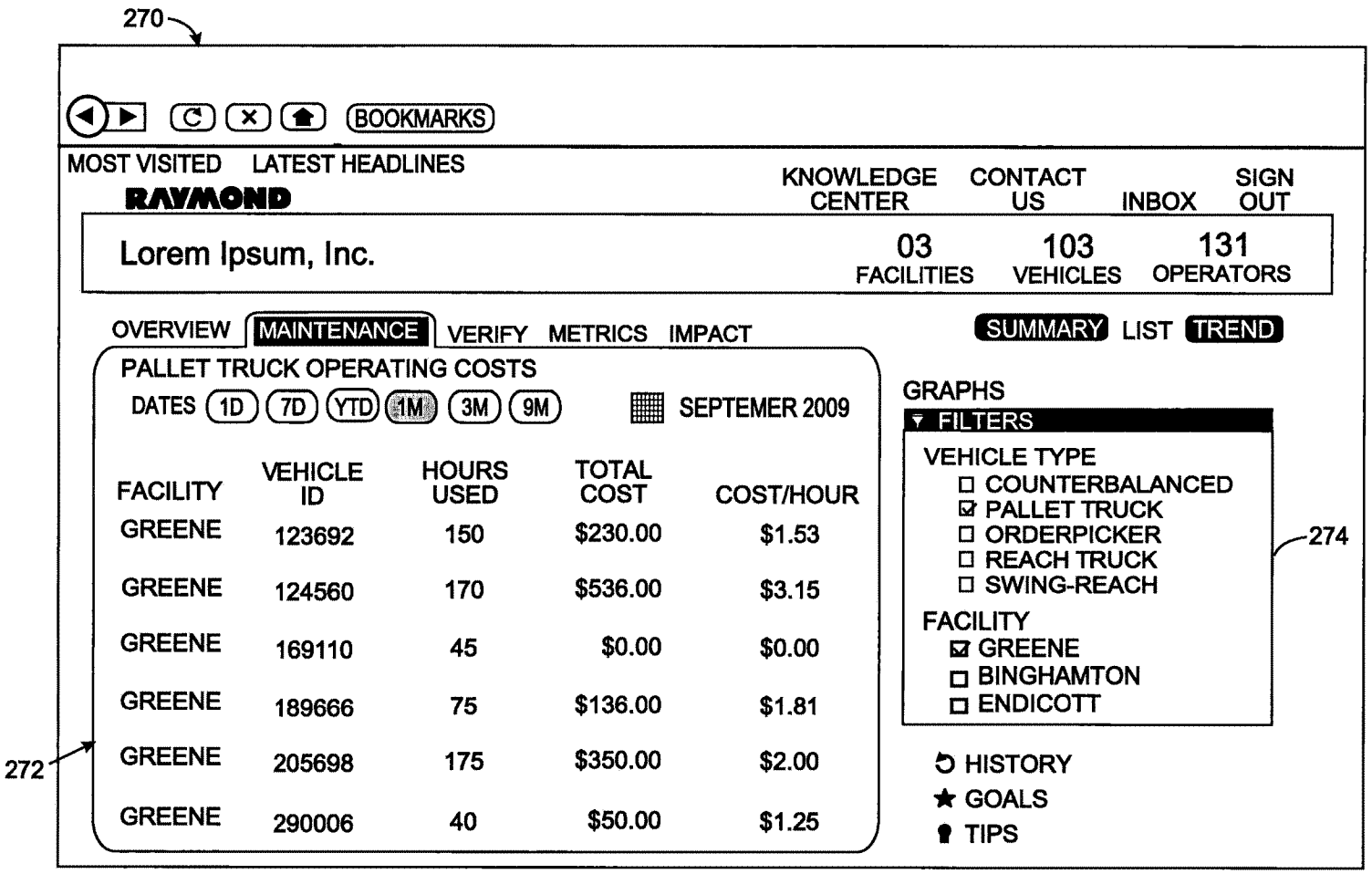
FIG. 20 illustrates a computer display screen presenting data regarding the operating costs for one type of material handling vehicle at the one warehouse.

With reference to FIG. 20, the list display mode 270 for the maintenance report mode provides a table 272 that has an entry for each vehicle that satisfies the filter criteria specified in the menu 274. In this example, counterbalanced trucks at the Green facility are designated. For each material handling vehicle on the list, the total number of operating hours during the defined period are stated. In addition, the total operating cost for each vehicle and the per hour operating cost for each vehicle during the defined period are listed. By clicking the mouse on one of the vehicle identification numbers in the table, a transition occurs to another display table listing specific cost data and maintenance information for only that one vehicle.

Figure 21:
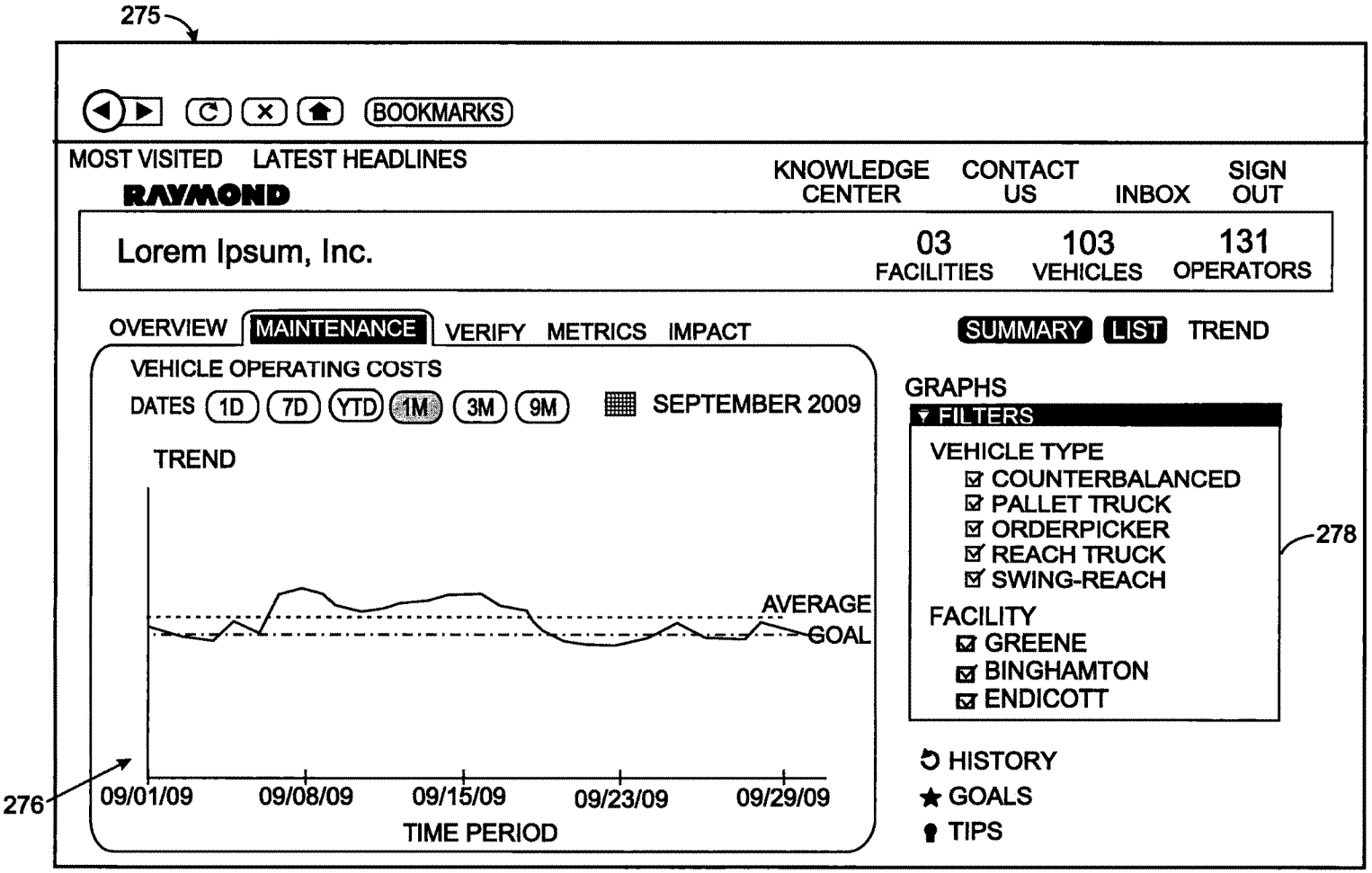
FIG. 21 illustrates a computer display screen presenting data about operating costs for a specific material handling vehicle at the one warehouse.

Referring to FIG. 21, the exemplary trend display mode 275 of the maintenance report mode that presents a line graph 276 with information regarding the hourly operating costs for the pallet trucks at one of the facilities during September 2009. A dashed horizontal line denotes the average hourly operating cost for those vehicles and the dashed and dotted horizontal line indicates the cost goal set for these vehicles at this facility. The user can use the menu 278 to select other combinations of vehicle types and facilities for the displayed data.

The foregoing description was primarily directed to a preferred embodiment of the invention. Although some attention was given to various alternatives within the scope of the invention, it is anticipated that one skilled in the art will likely realize additional alternatives that are now apparent from disclosure of embodiments of the invention. Accordingly, the scope of the invention should be determined from the following claims and not limited by the above disclosure.

The invention claimed is:

1. A system, for managing a plurality of material handling vehicles at a facility, comprising:

a sensor on each material handling vehicle to monitor at least one of speed and acceleration of the material handling vehicle;

a communication interface on each material handling vehicle which transmits and receives data regarding vehicle operation, the data regarding vehicle operation including at least one of speed data and acceleration data;

a communications system that receives the data from each communication interface; and a computer system comprising a processor, a user input device and a monitor having a screen on which information is displayed, and being connected to the communications system for processing the data from each of the material handling vehicles, including the at least one of speed data and acceleration data, and presenting reports on the screen based on the processed data from each of the material handling vehicles, including the at least one of speed data and acceleration data, the computer system operating in a plurality of report modes that comprises an impact report mode presenting reports about collisions of material handling vehicles with objects, a maintenance report mode presenting reports about maintenance and service performed on the material handling vehicles, a verify report mode presenting data about inspections performed on the material handling vehicles, and a metrics report mode presenting reports about amounts of work performed by the material handling vehicles, and an overview report mode presenting an overview report that contains separate graphs each summarizing report information from a different one of the impact, maintenance, verify, and metrics report modes, the processor to limit at least one vehicle operating parameter based on at least one of the presented reports, the at least one vehicle operating parameter including at least one of speed and acceleration;

wherein the computer system transitions from the overview report mode to another report mode that is selected in response to activation of the user input device, each of the impact, maintenance, verify, and metrics report modes has a summary display mode with a graph that presents data compiled from the plurality of material handling vehicles at the facility, a list display mode with a table that individually lists data about each one of at least some of the plurality of material handling vehicles, and a trend display mode containing a graph that presents a trend line of data during a defined time period, wherein the summary display mode, list display mode and the trend display mode is selectable in response a user activating the user input device to select an element presented on the screen.

2. The system as recited in claim 1 wherein in the list display mode of each of the impact, maintenance, verify, and metrics report modes, the computer system responds to another activation of the user input device by presenting information pertaining to only material handling vehicle on the screen.

3. The system as recited in claim 2 wherein the one material handling vehicle is designated in the list display mode by operation of the user input device placing a cursor on the screen location associated with the one material handling vehicle.

4. The system as recited in claim 1 wherein trend display mode extrapolates the trend line of data beyond the defined time period to predict data in a future time period.

5. The system as recited in claim 1 wherein the computer system comprises a storage device that stores a profile of a specific person authorized to use the system wherein that profile defines types of data that can be used in the report modes.

6. The system as recited in claim 1 wherein the computer system comprises a storage device that stores a profile for a specific person authorized to use the system wherein that profile defines a default report mode that appears on the screen when the specific person accesses the system.

7. The system as recited in claim 1 wherein the computer system comprises a storage device that stores a profile of a specific person authorized to use the system wherein that profile defines at least one bookmark designating at a given display mode for one of the report modes.

8. A system, for managing a plurality of material handling vehicles at a facility, comprising:

a temperature sensor on each material handling vehicle;

a communication interface on each material handling vehicle which transmits and receives data regarding vehicle operation, the data regarding vehicle operation including vehicle temperature data;

a communications system that receives the data from each communication interface; and a computer system comprising a processor, a user input device and a monitor having a screen on which information is displayed, and being connected to the communications system for processing the data from each of the material handling vehicles, including the vehicle temperature data, and presenting reports on the screen based on the processed data from each of the material handling vehicles, including the vehicle temperature data, the computer system operating in a plurality of report modes that comprises an impact report mode presenting reports about collisions of material handling vehicles with objects, a maintenance report mode presenting reports about maintenance and service performed on the material handling vehicles, a verify report mode presenting data about inspections performed on the material handling vehicles, and a metrics report mode presenting reports about amounts of work performed by the material handling vehicles, and an overview report mode presenting an overview report that contains separate graphs each summarizing report information from a different one of the impact, maintenance, verify, and metrics report modes, the processor to control at least one of a vehicle speed and a vehicle acceleration based on the vehicle temperature data from at least one of the presented reports;

wherein the computer system transitions from the overview report mode to another report mode that is selected in response to activation of the user input device, each of the impact, maintenance, verify, and metrics report modes has a first display mode with a graph that presents data compiled from the plurality of material handling vehicles at the facility, and in response to activating the user input device to select an element presented on the screen in the first display mode, the computer system transitions to a second display mode that presents information pertaining to only one material handling vehicle designated by the element.

9. The system as recited in claim 8 wherein the overview report mode comprises an impact section containing a graph of amounts of vehicle collisions that occurred during a defined period of time, a metrics section containing a graph of how many of the material handling vehicles were in use at a plurality of points in a defined period of time; a verify section that graphically depicts how many vehicles passed the inspections; and a maintenance section that graphically depicts operating costs for groups of the plurality of material handling vehicles.

10. The system as recited in claim 9 wherein the computer system transitions from the overview report mode to another report mode in response to operation of the user input device placing a cursor on the screen into one of the impact section, the metrics section, the verify section and the maintenance section.

11. The system as recited in claim 8 wherein activating the user input device to select an element responds to placement of a cursor over the element on the screen.

12. The system as recited in claim 8 wherein the impact report mode comprises a list display mode with a table containing an entry for each collision involving at least some of the plurality of material handling vehicles, and each such entry indicates a time and an intensity of the collision.

13. The system as recited in claim 12 wherein each entry in the list display mode indicates an operator of the material handling vehicle at the time of the related collision.

14. The system as recited in claim 13 wherein in response to activation of the user input device the computer system transitions from the list display mode to a display mode in which information about one selected operator of the material handling vehicle is presented on the screen.

15. The system as recited in claim 8 wherein the impact report mode comprises a graph depicting a trend in the amount of material handling vehicle collisions during a defined period of time.

16. The system as recited in claim 8 wherein the metrics report mode comprises a graph indicating a percentage of the plurality of material handling vehicles that were in use during a defined period of time.

17. The system as recited in claim 8 wherein the metrics report mode comprises a graph depicting a trend in the amount of the plurality of material handling vehicles that were in use during a defined period of time and an extrapolation of that trend into a future time period.

18. The system as recited in claim 8 wherein the maintenance report mode comprises a first display mode that indicates operating costs for different groups of the plurality of material handling vehicles, and a second display mode that indicates operating costs for a specific one of the plurality of material handling vehicles.

19. The system as recited in claim 8 wherein the maintenance report mode comprises a graph depicting a trend in-operating costs for the plurality of material handling vehicles during a defined period of time and an extrapolation of that trend into a future time period.

20. The system as recited in claim 8 wherein the computer system comprises a storage device that stores a profile of a specific person authorized to use the system wherein that profile defines types of data that can be used in the report modes.

21. The system as recited in claim 8 wherein the computer system comprises a storage device that stores a profile for a specific person authorized to use the system wherein that profile defines a default report mode that appears on the screen when the specific person accesses the system.

22. The system as recited in claim 8 wherein the computer system comprises a storage device that stores a profile of a specific person authorized to use the system wherein that profile defines at least one bookmark designating at a given display mode for one of the report modes.

23. A system for managing a plurality of material handling vehicles at a plurality of facilities comprising:

a battery on each material handling vehicle;

a communication interface on each material handling vehicle which transmits and receives data regarding vehicle operation, the data regarding vehicle operation including a battery state data;

a communication system that receives the data from each communication interface;

a computer system comprising a processor, a user input device and a monitor having a display screen on which information is displayed, and being connected to the communication system for processing the data from each of the material handling vehicles including the battery state data, and presenting reports on the display screen based on the processed data from each of the material handling vehicles, including the battery state data; the computer system operating in a plurality of report modes that comprise an impact report mode presenting reports about collisions of material handling vehicles with objects, a maintenance report mode presenting reports about maintenance and service performed on the material handling vehicles, a verify report mode presenting information about inspections performed on material handling vehicles, and a metrics report mode presenting reports about amounts of usage of material handling vehicles during defined periods of time, and an overview report mode presenting an overview report that contains separate graphs each summarizing report information from a different one of the impact, maintenance, verify, and metrics modes for all the plurality of facilities, wherein each report mode has a plurality of display modes, the processor to control at least one of a vehicle speed and a vehicle acceleration based on the battery state data from at least one of the presented reports;

wherein the computer system transitions from the overview report mode to another report mode that is selected in response to activation of the user input device, each of the impact, maintenance, verify, and metrics modes has a first display mode with a graph that presents data compiled from all the plurality of material handling vehicles at all the plurality of facilities, and in response to activating the user input device to select an element presented on the display screen in the first display mode, the computer system transitions to a second display mode that presents information pertaining to only one of the plurality of facilities, and in response to activating the user input device to select another element presented on the display screen in the second display mode, the computer system transitions to a third display mode that presents information pertaining to only one of the plurality of material handling vehicles at the only one of the plurality of facilities.

24. The system as recited in claim 23 wherein the overview report mode comprises an impact section containing a graph of amounts of vehicle collisions that occurred during a defined period of time, a metrics section containing a graph of how many of the material handling vehicles were in use at a plurality of points in a defined period of time; a verify section that graphically depicts how many vehicles passed the inspections; and a maintenance section that graphically depicts operating costs for groups of the plurality of material handling vehicles.

25. The system as recited in claim 23 wherein each of the impact, maintenance, verify, and metrics report modes has a summary display mode with a graph that presents data compiled from the plurality of material handling vehicles at one or more of the facilities, a list display mode with a table that individually lists data about each one of at least some of the plurality of material handling vehicles, and a trend display mode containing a graph that presents a trend line of data during a defined time period, wherein the summary display mode, list display mode and the trend display mode is selectable in response a user activating the user input device to select an element presented on the screen.

26. The system as recited in claim 25 wherein another display mode containing data for only one material handling vehicle is selected in the list display mode by operation of the user input device placing a cursor on the screen location associated with one material handling vehicle.

27. The system as recited in claim 25 wherein trend display mode extrapolates the trend line of data beyond the defined time period to predict data in a future time period.

28. The system as recited in claim 23 wherein the computer system comprises a storage device that stores a profile of a specific person authorized to use the system wherein that profile defines types of data that can be used in the report modes.

29. The system as recited in claim 23 wherein the computer system comprises a storage device that stores a profile for a specific person authorized to use the system wherein that profile defines a default report mode that appears on the screen when the specific person accesses the system.

30. The system as recited in claim 23 wherein the computer system comprises a storage device that stores a profile of a specific person authorized to use the system wherein that profile defines at least one bookmark designating at a given display mode for one of the report modes.

* * * * *